US010453418B2

(12) United States Patent
Lim et al.

(10) Patent No.: US 10,453,418 B2
(45) Date of Patent: Oct. 22, 2019

(54) DISPLAY APPARATUS AND METHOD OF DRIVING THE SAME BASED ON REPRESENTATIVE GRAYSCALE OF FRAME

(71) Applicant: Samsung Display Co., Ltd., Yongin-Si, Gyeonggi-Do (KR)

(72) Inventors: Han-Byul Lim, Hwaseong-si (KR); Seunghwan Moon, Ansan-si (KR); Myungbo Sim, Chungcheongnam-do (KR); Junpyo Lee, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/824,349

(22) Filed: Nov. 28, 2017

(65) Prior Publication Data

US 2018/0261181 A1 Sep. 13, 2018

(30) Foreign Application Priority Data

Mar. 8, 2017 (KR) ..... 10-2017-0029581

(51) Int. Cl.

| | |
|---|---|
| ***G09G 5/02*** | (2006.01) |
| ***G09G 3/36*** | (2006.01) |
| ***G09G 3/32*** | (2016.01) |
| ***G09G 3/3291*** | (2016.01) |
| ***G09G 3/20*** | (2006.01) |

(52) U.S. Cl.

CPC ..... *G09G 3/3696* (2013.01); *G09G 3/2007* (2013.01); *G09G 3/3291* (2013.01); *G09G 3/3685* (2013.01); *G09G 5/02* (2013.01); *G09G 2310/08* (2013.01); *G09G 2320/0209* (2013.01); *G09G 2320/0242* (2013.01); *G09G 2320/0247* (2013.01); *G09G 2320/043* (2013.01); *G09G 2360/16* (2013.01)

(58) Field of Classification Search

CPC ..... G09G 3/3655; G09G 2310/027; G09G 2360/16; G09G 3/3291; G09G 3/3685; G09G 3/3696; G09G 5/02

See application file for complete search history.

(56) References Cited

U.S. PATENT DOCUMENTS

2010/0033414 A1* 2/2010 Jeong ..... G09G 3/3655 345/89

FOREIGN PATENT DOCUMENTS

| | | | |
|---|---|---|---|
| KR | 1020100018320 | A | 2/2010 |
| KR | 101049142 | B1 | 7/2011 |
| KR | 101363680 | B1 | 2/2014 |
| KR | 101475072 | B1 | 12/2014 |

* cited by examiner

*Primary Examiner* — Xuemei Zheng

(74) *Attorney, Agent, or Firm* — Cantor Colburn LLP

(57) ABSTRACT

A display apparatus includes a timing controller, a common voltage generator, a data driver, and a display panel. The timing controller determines a representative grayscale of each frame based on input image data and generates a common voltage control signal having a first digital value ratio ("DVR") value corresponding to a first frame, a representative grayscale of the first frame being included in a first grayscale range. The common voltage generator generates a first common voltage based on the common voltage control signal. The data driver generates a data voltage based on the input image data. The display panel displays an image corresponding to the first frame based on the data voltage and the first common voltage.

21 Claims, 30 Drawing Sheets

FIG. 5A

| Color | Gray Scale | | | DVR Value | | | | | | | | | | | Best DVR Value |
|---|---|---|---|---|---|---|---|---|---|---|---|---|---|---|---|
| | R | G | B | 0 | 13 | 26 | 39 | 52 | 63 | 76 | 89 | 102 | 115 | 127 | |
| Dark Skin | 94 | 28 | 13 | 5.00 | 3.34 | 1.98 | 1.08 | 0.71 | 0.62 | 0.52 | 0.63 | 1.27 | 2.25 | 3.40 | 76 |
| Light Skin 1 | 197 | 151 | 130 | 4.40 | 3.96 | 3.49 | 3.07 | 2.68 | 2.42 | 2.23 | 2.20 | 2.38 | 2.78 | 3.37 | 89 |
| Light Skin 2 | 241 | 149 | 108 | 4.11 | 3.62 | 3.12 | 2.69 | 2.34 | 2.14 | 2.08 | 2.31 | 2.82 | 3.67 | 4.69 | 76 |
| Moderate Red 1 | 197 | 85 | 98 | 3.08 | 2.57 | 2.08 | 1.64 | 1.27 | 1.00 | 0.73 | 0.57 | 0.74 | 1.30 | 2.03 | 89 |
| Moderate Red 2 | 222 | 29 | 42 | 4.38 | 3.73 | 3.23 | 3.03 | 3.18 | 3.55 | 4.31 | 5.36 | 6.64 | 8.04 | 9.38 | 39 |
| Deep Red | 178 | 47 | 58 | 4.40 | 3.78 | 3.27 | 2.94 | 2.85 | 2.93 | 3.29 | 3.93 | 4.86 | 6.02 | 7.22 | 52 |
| Orange | 255 | 116 | 21 | 3.43 | 2.97 | 2.45 | 1.83 | 1.14 | 0.65 | 1.04 | 2.11 | 3.47 | 5.03 | 6.63 | 63 |
| Yellow | 255 | 217 | 0 | 1.61 | 1.61 | 1.59 | 1.53 | 1.43 | 1.30 | 1.13 | 0.92 | 0.68 | 0.47 | 0.41 | 127 |
| Greenish Yellow | 213 | 222 | 53 | 1.53 | 1.32 | 1.19 | 1.10 | 1.02 | 0.97 | 0.98 | 1.19 | 1.63 | 2.27 | 3.01 | 63 |
| Dark Violet | 92 | 59 | 107 | 2.44 | 2.40 | 2.51 | 2.67 | 2.80 | 2.84 | 2.74 | 2.48 | 2.02 | 1.43 | 0.84 | 127 |
| Purplish Blue | 74 | 92 | 165 | 2.69 | 2.18 | 1.69 | 1.26 | 0.94 | 0.81 | 0.90 | 1.15 | 1.44 | 1.74 | 2.02 | 63 |
| Dull Blue | 46 | 62 | 151 | 1.73 | 0.97 | 0.38 | 0.52 | 0.97 | 1.30 | 1.54 | 1.68 | 1.78 | 1.98 | 2.36 | 26 |
| Dull Cyan | 86 | 133 | 135 | 3.73 | 3.91 | 4.09 | 4.28 | 4.43 | 4.52 | 4.56 | 4.47 | 4.24 | 3.82 | 3.19 | 127 |
| Olive Green | 69 | 150 | 70 | 1.90 | 1.69 | 1.59 | 1.54 | 1.45 | 1.35 | 1.24 | 1.35 | 1.89 | 2.83 | 3.95 | 76 |
| Foliage | 90 | 103 | 39 | 2.62 | 2.61 | 2.65 | 2.57 | 2.28 | 1.88 | 1.44 | 1.74 | 3.02 | 4.80 | 6.67 | 76 |

FIG. 5G

| COLOR | GRAY SCALE | | | MCD | | |
|---|---|---|---|---|---|---|
| | R | G | B | BEFORE | AFTER | VARIATION |
| DARK SKIN | 94 | 28 | 13 | 1.08 | 0.54 | -0.54 |
| LIGHT SKIN 1 | 197 | 151 | 130 | 3.07 | 1.84 | -1.23 |
| LIGHT SKIN 2 | 241 | 149 | 108 | 2.69 | 1.94 | -0.75 |
| MODERATE RED 1 | 197 | 85 | 98 | 1.64 | 0.42 | -1.22 |
| MODERATE RED 2 | 222 | 29 | 42 | 3.03 | 3.03 | 0.00 |
| DEEP RED | 178 | 47 | 58 | 2.94 | 2.83 | -0.11 |
| ORANGE | 255 | 116 | 21 | 1.83 | 0.65 | -1.18 |
| YELLOW | 255 | 217 | 0 | 1.53 | 1.34 | -0.20 |
| GREENISH YELLOW | 213 | 222 | 53 | 1 10 | 0.95 | -0.15 |
| DARK VIOLET | 92 | 59 | 107 | 2.67 | 0.57 | -2.10 |
| PURPLISH BLUE | 74 | 92 | 165 | 1.26 | 0.87 | -0.40 |
| DULL BLUE | 46 | 62 | 151 | 0.52 | 0.37 | -0.15 |
| DULL CYAN | 86 | 133 | 135 | 4.28 | 4.03 | -0.25 |
| OLIVE GREEN | 69 | 150 | 70 | 1.54 | 1.25 | -0.29 |
| FOLIAGE | 90 | 103 | 39 | 2.57 | 1.41 | -1 16 |
| AVERAGE | | | | 2.12 | 1.47 | -0.65 |
| AVERAGE OF TOP THREE | | | | 3.46 | 3.30 | -0.16 |

FIG. 6A

| Color | Gray Scale | | | DVR Value | | | | | | | | | | | Best DVR Value |
|---|---|---|---|---|---|---|---|---|---|---|---|---|---|---|---|
| | R | G | B | 0 | 15 | 33 | 43 | 53 | 63 | 73 | 83 | 93 | 112 | 127 | |
| Dark Skin | 94 | 28 | 13 | 6.01 | 3.65 | 1.63 | 1.11 | 1.22 | 1.50 | 1.72 | 2.27 | 2.82 | 3.00 | 3.69 | 43 |
| Light Skin 1 | 197 | 151 | 130 | 2.32 | 1.57 | 1.03 | 1.23 | 1.65 | 2.14 | 2.18 | 2.29 | 2.54 | 2.78 | 3.25 | 33 |
| Light Skin 2 | 241 | 149 | 108 | 3.32 | 2.25 | 1.82 | 2.27 | 3.01 | 3.71 | 3.99 | 4.03 | 4.08 | 4.01 | 4.24 | 33 |
| Moderate Red 1 | 197 | 85 | 98 | 3.52 | 2.44 | 1.40 | 1.02 | 1.11 | 1.26 | 1.38 | 1.58 | 2.07 | 2.80 | 3.68 | 43 |
| Moderate Red 2 | 222 | 29 | 42 | 8.62 | 5.99 | 3.25 | 1.49 | 0.75 | 0.71 | 0.80 | 1.44 | 2.64 | 3.85 | 4.93 | 63 |
| Deep Red | 178 | 47 | 58 | 6.79 | 4.67 | 2.33 | 1.05 | 0.99 | 1.18 | 1.23 | 1.40 | 1.92 | 2.58 | 3.22 | 53 |
| Orange | 255 | 116 | 21 | 4.05 | 4.04 | 4.49 | 4.77 | 5.19 | 5.92 | 6.17 | 6.83 | 7.54 | 8.00 | 8.58 | 15 |
| Yellow | 255 | 217 | 0 | 0.17 | 0.56 | 1.01 | 1.43 | 1.69 | 1.87 | 1.92 | 1.94 | 1.85 | 1.69 | 1.53 | 0 |
| Greenish Yellow | 213 | 222 | 53 | 4.70 | 3.19 | 1.62 | 0.88 | 0.75 | 0.84 | 0.90 | 0.97 | 1.28 | 1.75 | 2.30 | 53 |
| Dark Violet | 92 | 59 | 107 | 3.69 | 2.26 | 1.40 | 1.26 | 1.58 | 1.50 | 1.56 | 1.78 | 2.26 | 2.81 | 3.32 | 43 |
| Purplish Blue | 74 | 92 | 165 | 3.76 | 2.58 | 1.53 | 0.83 | 0.75 | 1.01 | 1.11 | 1.47 | 2.24 | 3.11 | 4.26 | 53 |
| Dull Blue | 46 | 62 | 151 | 4.65 | 2.72 | 1.26 | 0.53 | 0.69 | 1.01 | 0.99 | 1.15 | 1.51 | 1.96 | 2.61 | 43 |
| Dull Cyan | 86 | 133 | 135 | 2.18 | 1.53 | 1.49 | 1.60 | 1.91 | 2.25 | 2.37 | 2.58 | 2.88 | 3.16 | 3.59 | 33 |
| Olive Green | 69 | 150 | 70 | 4.81 | 3.21 | 1.66 | 1.34 | 1.60 | 2.00 | 2.06 | 2.26 | 2.47 | 2.69 | 3.00 | 43 |
| Foliage | 90 | 103 | 39 | 6.36 | 4.40 | 2.60 | 1.63 | 1.54 | 1.90 | 2.00 | 2.37 | 3.11 | 3.92 | 4.76 | 53 |

FIG. 7A

| Color | Gray Scale | | | DVR Value | | | | | | | | | | | Best DVR Value |
|---|---|---|---|---|---|---|---|---|---|---|---|---|---|---|---|
| | R | G | B | 0 | 15 | 33 | 43 | 53 | 63 | 73 | 83 | 93 | 112 | 127 | |
| Dark Skin | 94 | 28 | 13 | 14.60 | 12.88 | 10.21 | 7.68 | 3.86 | 0.65 | 1.99 | 4.44 | 9.54 | 14.70 | 19.76 | 63 |
| Light Skin 1 | 197 | 151 | 130 | 4.58 | 3.11 | 1.85 | 1.15 | 1.78 | 2.66 | 3.13 | 3.09 | 2.43 | 2.98 | 5.80 | 43 |
| Light Skin 2 | 241 | 149 | 108 | 5.47 | 3.58 | 2.32 | 2.34 | 2.90 | 3.27 | 2.98 | 1.84 | 1.78 | 5.63 | 9.15 | 93 |
| Moderate Red 1 | 197 | 85 | 98 | 6.98 | 5.44 | 3.93 | 2.67 | 1.83 | 1.78 | 1.84 | 1.60 | 1.62 | 3.26 | 5.51 | 83 |
| Moderate Red 2 | 222 | 29 | 42 | 10.85 | 8.30 | 5.61 | 3.00 | 1.25 | 1.28 | 0.80 | 1.94 | 5.55 | 9.46 | 12.97 | 73 |
| Deep Red | 178 | 47 | 58 | 10.49 | 8.21 | 5.63 | 3.32 | 1.79 | 1.43 | 0.73 | 1.92 | 5.37 | 8.95 | 13.05 | 73 |
| Orange | 255 | 116 | 21 | 6.52 | 5.54 | 5.22 | 5.22 | 4.67 | 3.34 | 1.82 | 1.91 | 5.64 | 9.81 | 13.60 | 73 |
| Yellow | 255 | 217 | 0 | 2.02 | 2.42 | 2.62 | 2.71 | 2.62 | 2.46 | 2.00 | 1.36 | 0.66 | 1.05 | 2.33 | 93 |
| Greenish Yellow | 213 | 222 | 53 | 9.94 | 8.09 | 6.10 | 4.29 | 2.62 | 1.66 | 1.32 | 1.57 | 2.75 | 4.54 | 6.44 | 73 |
| Dark Violet | 92 | 59 | 107 | 9.58 | 7.80 | 5.62 | 3.70 | 1.92 | 1.11 | 1.25 | 1.28 | 0.56 | 0.83 | 2.59 | 93 |
| Purplish Blue | 74 | 92 | 165 | 7.83 | 6.19 | 4.48 | 3.04 | 1.72 | 0.98 | 1.08 | 1.64 | 2.27 | 2.82 | 3.67 | 63 |
| Dull Blue | 46 | 62 | 151 | 10.22 | 8.13 | 5.74 | 3.58 | 1.59 | 0.70 | 1.25 | 1.64 | 1.97 | 3.10 | 4.89 | 63 |
| Dull Cyan | 86 | 133 | 135 | 4.55 | 3.44 | 2.34 | 1.71 | 2.09 | 2.95 | 3.44 | 3.43 | 2.30 | 2.51 | 6.91 | 43 |
| Olive Green | 69 | 150 | 70 | 8.95 | 6.65 | 4.46 | 2.57 | 1.34 | 1.11 | 0.95 | 1.54 | 4.12 | 7.57 | 11.45 | 73 |
| Foliage | 90 | 103 | 39 | 11.45 | 9.82 | 7.12 | 4.53 | 2.54 | 1.71 | 2.32 | 4.96 | 9.44 | 14.06 | 18.10 | 63 |

FIG. 8A

| Color | Gray Scale | | | DVR Value | | | | | | | Best DVR Value |
|---|---|---|---|---|---|---|---|---|---|---|---|
| | R | G | B | 0 | 23 | 43 | 63 | 83 | 103 | 127 | |
| Dark Skin | 94 | 28 | 13 | 11.16 | 8.80 | 4.50 | 2.39 | 3.25 | 6.15 | 7.77 | 63 |
| Light Skin 1 | 197 | 151 | 130 | 1.50 | 1.75 | 2.44 | 2.82 | 3.48 | 3.34 | 3.10 | 0 |
| Light Skin 2 | 241 | 149 | 108 | 2.26 | 2.79 | 3.65 | 3.81 | 3.86 | 2.70 | 2.03 | 127 |
| Moderate Red 1 | 197 | 85 | 98 | 4.30 | 4.44 | 4.97 | 5.36 | 5.59 | 4.56 | 2.03 | 127 |
| Moderate Red 2 | 222 | 29 | 42 | 3.12 | 2.42 | 2.27 | 2.19 | 1.17 | 1.93 | 3.25 | 83 |
| Deep Red | 178 | 47 | 58 | 4.37 | 3.61 | 2.97 | 2.93 | 2.49 | 1.98 | 2.83 | 103 |
| Orange | 255 | 116 | 21 | 5.78 | 5.75 | 5.07 | 4.03 | 2.30 | 1.05 | 2.03 | 103 |
| Yellow | 255 | 217 | 0 | 1.83 | 1.92 | 2.06 | 2.10 | 1.76 | 1.34 | 1.15 | 127 |
| Greenish Yellow | 213 | 222 | 53 | 1.04 | 0.77 | 0.86 | 0.95 | 1.06 | 0.59 | 0.32 | 127 |
| Dark Violet | 92 | 59 | 107 | 3.98 | 3.35 | 2.38 | 2.68 | 2.78 | 3.49 | 3.84 | 43 |
| Purplish Blue | 74 | 92 | 165 | 2.27 | 1.93 | 2.00 | 2.84 | 3.31 | 3.72 | 3.79 | 23 |
| Dull Blue | 46 | 62 | 151 | 3.36 | 2.54 | 1.71 | 2.25 | 2.57 | 3.08 | 3.54 | 43 |
| Dull Cyan | 86 | 133 | 135 | 1.43 | 0.70 | 0.70 | 1.83 | 2.72 | 3.18 | 3.28 | 43 |
| Olive Green | 69 | 150 | 70 | 4.67 | 3.87 | 2.93 | 3.09 | 3.55 | 5.29 | 6.46 | 43 |
| Foliage | 90 | 103 | 39 | 8.25 | 7.11 | 5.55 | 5.43 | 6.50 | 9.60 | 11.38 | 63 |

DISPLAY APPARATUS AND METHOD OF DRIVING THE SAME BASED ON REPRESENTATIVE GRAYSCALE OF FRAME

This application claims priority under 35 U.S.C. § 119 to Korean Patent Application No. 10-2017-0029581, filed on Mar. 8, 2017, and all the benefits accruing therefrom under 35 U.S.C. § 119, the content of which in its entirety is herein incorporated by reference.

BACKGROUND

1. Field

Exemplary embodiments of the invention relate generally to display devices, and more particularly to display apparatuses and methods of driving the display apparatuses.

2. Description of the Related Art

A display apparatus, such as a liquid crystal display ("LCD") apparatus and an organic light emitting display apparatus, includes a display panel and a panel driver. The display panel includes a plurality of gate lines, a plurality of data lines and a plurality of pixels connected to the gate lines and the data lines. The panel driver includes a gate driver providing gate signals to the plurality of gate lines and a data driver providing data voltages to the plurality of data lines.

The LCD apparatus includes a first substrate including a pixel electrode, a second substrate including a common electrode and a liquid crystal layer disposed between the first and second substrates. An electric field is generated by voltages respectively applied to the pixel electrode and the common electrode. By adjusting an intensity of the electric field, a transmittance of a light passing through the liquid crystal layer may be adjusted so that a desired image may be displayed.

The organic light emitting display apparatus displays images using organic light emitting diodes ("OLEDs"). The OLED generally includes an organic layer between two electrodes, i.e., an anode and a cathode. Holes from the anode may be combined with electrons from the cathode in the organic layer between the anode and the cathode to emit light.

SUMMARY

Generally, a common voltage applied to a common electrode is set according to a kickback voltage. The common voltage affects display quality such as an occurrence of afterimage, crosstalk, flicker, and so on. Especially, as the number of gate lines in a display panel increases, a charging duration of each pixel decreases. Accordingly, the common voltage may further affect the display quality.

Exemplary embodiments of the invention provide a display apparatus capable of improving display quality.

Exemplary embodiments of the invention provide a method of driving the display apparatus.

Exemplary embodiments of the invention provide another method of driving the display apparatus.

A display apparatus according to an exemplary embodiment of the invention includes a timing controller, a common voltage generator, a data driver, and a display panel. The timing controller determines a representative grayscale of each frame based on input image data and generates a common voltage control signal having a first digital value ratio ("DVR") value corresponding to a first frame, a representative grayscale of the first frame being included in a first grayscale range. The common voltage generator generates a first common voltage based on the common voltage control signal. The data driver generates a data voltage based on the input image data. The display panel displays an image corresponding to the first frame based on the data voltage and the first common voltage.

In an exemplary embodiment, the first grayscale range may be a grayscale range to display a dark skin color (Dark Skin).

In an exemplary embodiment, a red grayscale of the first grayscale range may be greater than or equal to 91 and less than or equal to 97. A green grayscale of the first grayscale range may be greater than or equal to 25 and less than or equal to 31. A blue grayscale of the first grayscale range may be greater than or equal to 10 and less than or equal to 16.

In an exemplary embodiment, the first DVR value may be greater than or equal to 64 and less than or equal to 88.

In an exemplary embodiment, the first grayscale range may be a grayscale range to display a first light skin color (Light Skin 1).

In an exemplary embodiment, a red grayscale of the first grayscale range may be greater than or equal to 194 and less than or equal to 200. A green grayscale of the first grayscale range may be greater than or equal to 148 and less than or equal to 154. A blue grayscale of the first grayscale range may be greater than or equal to 127 and less than or equal to 133.

In an exemplary embodiment, the first DVR value may be greater than or equal to 77 and less than or equal to 101.

In an exemplary embodiment, the first grayscale range may be a grayscale range to display a light skin color (Light Skin 2).

In an exemplary embodiment, a red grayscale of the first grayscale range may be greater than or equal to 238 and less than or equal to 244. A green grayscale of the first grayscale range may be greater than or equal to 146 and less than or equal to 152. A blue grayscale of the first grayscale range may be greater than or equal to 105 and less than or equal to 111.

In an exemplary embodiment, the first DVR value may be greater than or equal to 64 and less than or equal to 88.

In an exemplary embodiment, the first common voltage may satisfy an equation below:

$$VCOM = VCOM_M - \frac{DVR+1}{DVR_M+1} VCOM_R,$$

where VCOM denotes the first common voltage, $VCOM_M$ denotes a maximum available value of a common voltage, $VCOM_R$ denotes a variable range of a common voltage, $DVR_M$ denotes a maximum DVR value, DVR denotes the first DVR value.

In an exemplary embodiment, the common voltage control signal may have a second DVR value corresponding to a second frame, a representative grayscale of the second frame being included in a second grayscale range different from the first grayscale range. The common voltage generator may further generate a second common voltage based on the common voltage control signal. The display panel may display an image corresponding to the second frame based on the data voltage and the second common voltage.

In an exemplary embodiment, the timing controller may generate a grayscale histogram of each frame based on the input image data and may analyze the grayscale histogram to determine the representative grayscale of each frame.

In an exemplary embodiment, the timing controller may generate the grayscale histogram of each of a red grayscale, a green grayscale and a blue grayscale.

In an exemplary embodiment, the representative grayscale of each frame may be a most frequent grayscale of each frame.

In an exemplary embodiment, the display panel may display the image according to an intensity of an electric field generated by the first common voltage and the data voltage.

A method of driving a display apparatus according to an exemplary embodiment of the invention includes determining a representative grayscale of each frame based on input image data, generating a common voltage control signal having a first DVR (Digital Value Ratio) value corresponding to a first frame, a representative grayscale of the first frame being included in a first grayscale range, generating a first common voltage based on the common voltage control signal, generating a data voltage based on the input image data, and displaying an image corresponding to the first frame based on the data voltage and the first common voltage.

In an exemplary embodiment, the first grayscale range may be a grayscale range to display a dark skin color (Dark Skin) or a light skin color (Light Skin 2). The first DVR value may be greater than or equal to 64 and less than or equal to 88.

In an exemplary embodiment, the first grayscale range may be a grayscale range to display a first light skin color (Light Skin 1). The first DVR value may be greater than or equal to 77 and less than or equal to 101.

In an exemplary embodiment, the method may further comprise generating the common voltage control signal having a second DVR value corresponding to a second frame, a representative grayscale of the second frame being included in a second grayscale range different from the first grayscale range, generating a second common voltage based on the common voltage control signal, and displaying an image corresponding to the second frame based on the data voltage and the second common voltage.

In an exemplary embodiment, the determining the representative grayscale of each frame may comprise generating a grayscale histogram of each frame based on the input image data, and analyzing the grayscale histogram to determine the representative grayscale of each frame.

Another method of driving a display apparatus according to an exemplary embodiment of the invention includes generating a data voltage based on input image data, generating a first common voltage corresponding to a first input image having a first color, a mixed color difference ("MCD") of the first input image being a lowest value at the first common voltage, generating a second common voltage corresponding to a second input image having a second color different from the first color, an MCD of the second input image being the lowest value at the second common voltage, displaying the first input image based on the data voltage and the first common voltage, and displaying the second input image based on the data voltage and the second common voltage.

According to exemplary embodiments, a common voltage is controlled and set differently by each frame, based on a grayscale range in which a representative grayscale of the frame is included, so that an MCD of each frame can be the lowest value. Especially, for certain colors, the optimum common voltages obtained from the experiments can be used. Thus, the display quality of the display apparatus can be improved.

BRIEF DESCRIPTION OF THE DRAWINGS

The above and other features and advantages of the invention will become more apparent by describing in detailed exemplary embodiments thereof with reference to the accompanying drawings, in which:

FIG. 5A is a table illustrating an exemplary embodiment of a first experimental example of a mixed color difference ("MCD") according to a DVR value of each grayscale in a display apparatus;

FIG. 5G is a table illustrating a result of comparing an MCD before and after applying an optimum DVR value in FIG. 5A;

FIG. 6A is a table illustrating a second experimental example of an exemplary embodiment of an MCD according to a DVR value of each grayscale in a display apparatus;

FIG. 7A is a table illustrating a third experimental example of an exemplary embodiment of an MCD according to a DVR value of each grayscale in a display apparatus;

FIG. 8A is a table illustrating a fourth experimental example of an exemplary embodiment of an MCD according to a DVR value of each grayscale in a display apparatus.

DETAILED DESCRIPTION

Figure 1:
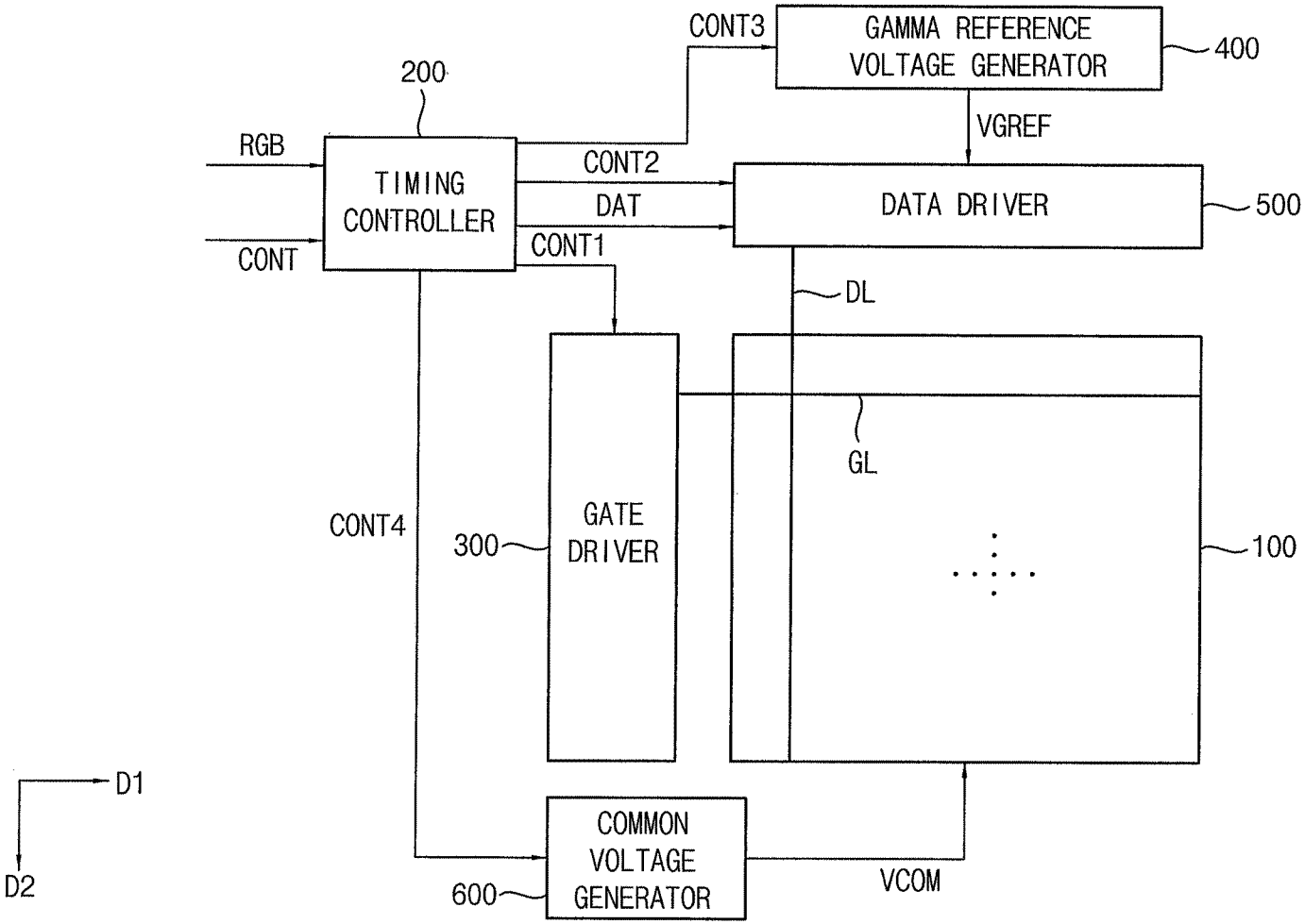
FIG. 1 is a block diagram illustrating an exemplary embodiment of a display apparatus according.

Hereinafter, the invention will be explained in detail with reference to the accompanying drawings. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram illustrating a display apparatus according to exemplary embodiments.

Referring to FIG. 1, the display apparatus includes a display panel 100 and a panel driver. The panel driver includes a timing controller 200, a gate driver 300, a gamma reference voltage generator 400, a data driver 500 and a common voltage generator 600.

The display panel 100 includes a display region for displaying an image and a peripheral region adjacent to the display region.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

The display panel 100 includes a common electrode and a pixel electrode. The display panel 100 displays the image according to an intensity of an electric field generated between the common electrode and the pixel electrode.

In some exemplary embodiments, the pixels may include a switching element (not shown), a liquid crystal capacitor (not shown) and a storage capacitor (not shown). The liquid crystal capacitor and the storage capacitor may be electrically connected to the switching element. In an exemplary embodiment, the pixels may be arranged in a matrix configuration, for example. However, the invention is not limited thereto, and the pixels may be arranged in various other configurations.

The timing controller 200 receives input image data RGB and an input control signal CONT from an external device (not shown). In an exemplary embodiment, the input image data RGB may include red image data R, green image data G and blue image data B, for example. In an exemplary embodiment, the input control signal CONT may include a master clock signal and a data enable signal, for example. In an exemplary embodiment, the input control signal CONT may further include a vertical synchronizing signal and a horizontal synchronizing signal, for example.

The timing controller 200 generates a first control signal CONT1, a second control signal CONT2, a third control signal CONT3, a fourth control signal CONT4 and a data signal DAT based on the input image data RGB and the input control signal CONT.

The timing controller 200 generates the first control signal CONT1 for controlling operations of the gate driver 300 based on the input control signal CONT, and outputs the first control signal CONT1 to the gate driver 300. In an exemplary embodiment, the first control signal CONT1 may include a vertical start signal and a gate clock signal, for example.

The timing controller 200 generates the second control signal CONT2 for controlling operations of the data driver 500 based on the input control signal CONT, and outputs the second control signal CONT2 to the data driver 500. In an exemplary embodiment, the second control signal CONT2 may include a horizontal start signal and a load signal, for example.

The timing controller 200 generates the data signal DAT based on the input image data RGB. The timing controller 200 outputs the data signal DAT to the data driver 500. The data signal DAT may be substantially the same image data as the input image data RGB or the data signal DAT may be compensated image data generated by compensating the input image data RGB. In an exemplary embodiment, the timing controller 200 may selectively perform an image quality compensation, a spot compensation, an adaptive color correction ("ACC"), and/or a dynamic capacitance compensation ("DCC") on the input image data RGB to generate the data signal DAT, for example.

The timing controller 200 generates the third control signal CONT3 for controlling operations of the gamma reference voltage generator 400 based on the input control signal CONT, and outputs the third control signal CONT3 to the gamma reference voltage generator 400.

The timing controller 200 generates the fourth control signal CONT4 for controlling operations of the common voltage generator 600 based on the input image data RGB. The timing controller 200 determines a representative grayscale of each frame based on the input image data RGB. The timing controller 200 may figure out which grayscale range among a plurality of grayscale ranges the representative grayscale is included in. The timing controller 200 generates a digital value ratio ("DVR") value corresponding to the grayscale range in which the representative grayscale is included. The DVR value is digital information used to determine a level of a common voltage VCOM. In an exemplary embodiment, the DVR value may be 0 to 127, for example. In an exemplary embodiment, the DVR value may be updated in each frame, for example. In an exemplary embodiment, the DVR value may be included in the fourth control signal CONT4, for example. The timing controller 200 outputs the fourth control signal CONT4 to the common voltage generator 600.

The operation of the timing controller 200 will be explained in detail with reference to FIGS. 2 to 4.

The gate driver 300 generates gate signals for driving the gate lines GL in response to the first control signal CONT1 received from the timing controller 200. The gate driver 300 sequentially outputs the gate signals to the gate lines GL.

In some exemplary embodiments, the gate driver 300 may be directly disposed (e.g., mounted) on the display panel 100, or may be connected to the display panel 100 as a tape carrier package ("TCP") type, for example. In an alternative exemplary embodiment, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In some exemplary embodiments, the gamma reference voltage generator 400 may be disposed in the timing controller 200, or may be disposed in the data driver 500, for example.

The data driver 500 receives the second control signal CONT2 and the data signal DAT from the timing controller 200, and receives the gamma reference voltage VGREF from the gamma reference voltage generator 400. The data driver 500 converts the data signal DAT to data voltages having analogue levels based on the gamma reference voltage VGREF. The data driver 500 outputs the data voltages to the pixel electrodes connected to the data lines DL.

In some exemplary embodiments, the data driver 500 may be directly disposed (e.g., mounted) on the display panel 100, or may be connected to the display panel 100 as a TCP type. In an alternative exemplary embodiment, the data driver 500 may be integrated on the peripheral region of the display panel 100.

The common voltage generator 600 generates the common voltage VCOM in response to the fourth control signal CONT4 received from the timing controller 200. The level of the common voltage VCOM may correspond to the DVR value included in the fourth control signal CONT4. The common voltage VCOM may be updated in each frame according to the DVR value. The common voltage generator 600 outputs the common voltage VCOM to the common electrode.

The operation of the common voltage generator 600 will be explained in detail with reference to FIG. 4.

The display panel 100 displays the image according to an intensity of an electric field generated between the common electrode to which the common voltage VCOM is applied and the pixel electrode to which the data voltage is applied.

Figure 2:
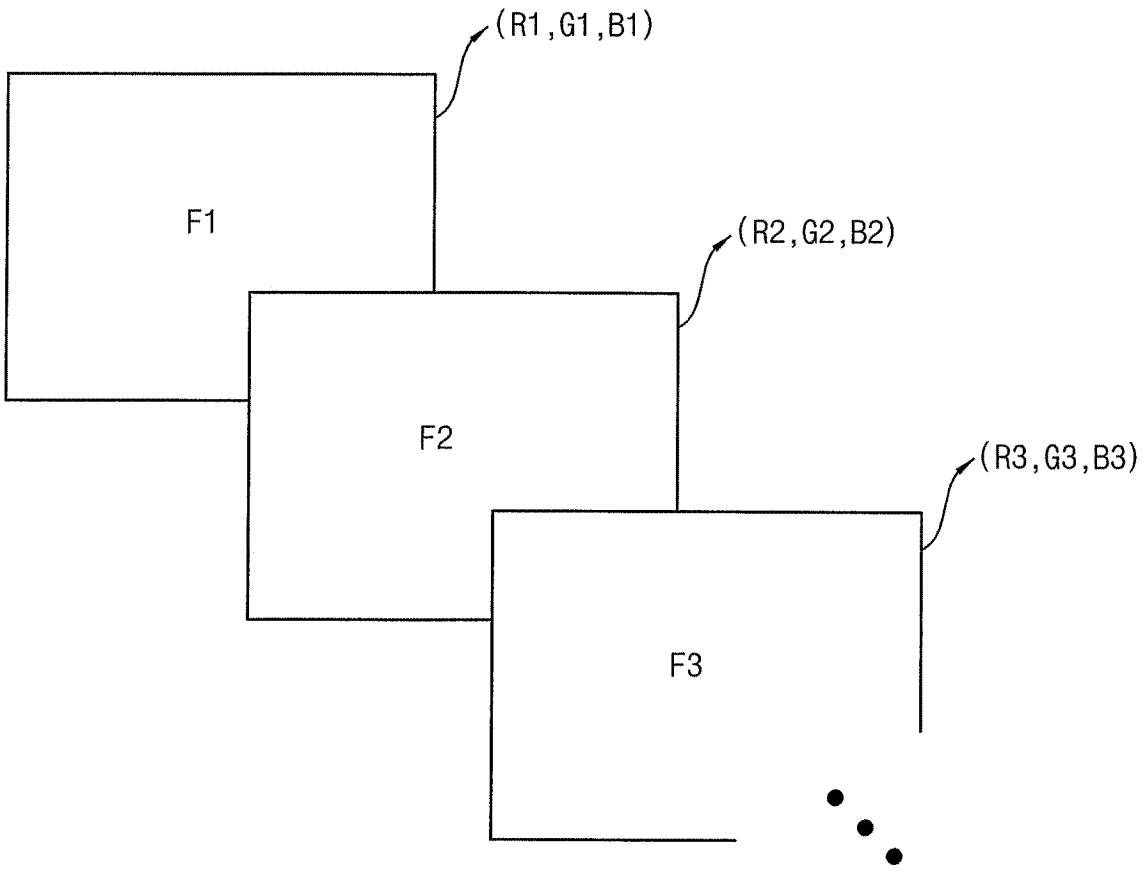
FIG. 2 is a diagram illustrating an exemplary embodiment of a representative grayscale of each frame of an input image in a display apparatus.

FIG. 2 is a diagram illustrating a representative grayscale of each frame of an input image in a display apparatus according to exemplary embodiments.

Referring to FIGS. 1 and 2, an input image may include a plurality of frames. The input image data RGB includes a grayscale (R, G, B) corresponding to each of the pixels for each frame. In an exemplary embodiment, the input image data RGB may include a grayscale corresponding to each of the pixels for a first frame F1, a grayscale corresponding to each of the pixels for a second frame F2, and a grayscale corresponding to each of the pixels for a third frame F3, for example.

The timing controller 200 determines the representative grayscale of each frame. In other words, the timing controller 200 determines the representative grayscale corresponding to each frame. The representative grayscale is a representative value of whole grayscales corresponding to each of the pixels for the frame. In an exemplary embodiment, the representative grayscale may be the most frequent grayscale of the frame, for example.

In an exemplary embodiment, the timing controller 200 may determine a first representative grayscale (R1, G1, B1) corresponding to the first frame F1, for example. The first representative grayscale (R1, G1, B1) may be a representative value of whole grayscales corresponding to each of the pixels for the first frame F1. The timing controller 200 may determine a second representative grayscale (R2, G2, B2) corresponding to the second frame F2. The second representative grayscale (R2, G2, B2) may be a representative value of whole grayscales corresponding to each of the pixels for the second frame F2. The timing controller 200 may determine a third representative grayscale (R3, G3, B3) corresponding to the third frame F3. The third representative grayscale (R3, G3, B3) may be a representative value of whole grayscales corresponding to each of the pixels for the third frame F3.

Figure 3:
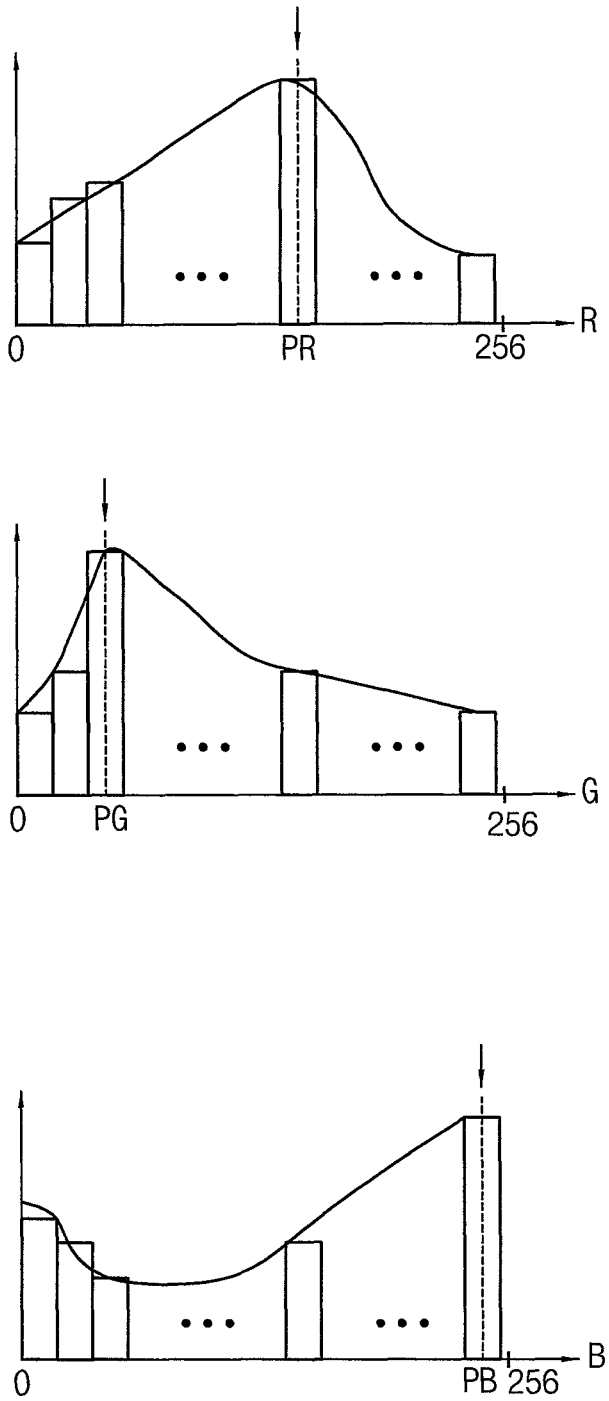
FIG. 3 is a diagram illustrating an exemplary embodiment of grayscale histograms generated by a timing controller included in a display apparatus.

FIG. 3 is a diagram illustrating grayscale histograms generated by a timing controller included in a display apparatus according to exemplary embodiments.

Referring to FIGS. 1 to 3, the timing controller 200 may generate a grayscale histogram of each frame based on the input image data RGB. In other words, the timing controller 200 may generate a grayscale histogram corresponding to each frame based on the input image data RGB. In an exemplary embodiment, the timing controller 200 may generate the grayscale histogram of red grayscales R, green grayscales G and blue grayscales B respectively, for example. The x-axis of the grayscale histogram is a grayscale of 0 to 255 and the y-axis of the grayscale histogram is a number of pixels having the grayscale.

The timing controller 200 may extract the most frequent grayscale of each frame by analyzing the grayscale histogram. In an exemplary embodiment, the timing controller 200 may extract the most frequent red grayscale PR by analyzing the grayscale histogram of red grayscales R, for example. The timing controller 200 may extract the most frequent green grayscale PG by analyzing the grayscale histogram of green grayscales G. The timing controller 200 may extract the most frequent blue grayscale PB by analyzing the grayscale histogram of blue grayscales. In this case, the timing controller 200 may designate the most frequent grayscale (PR, PG; PB) as the representative grayscale of the frame.

Figure 4:
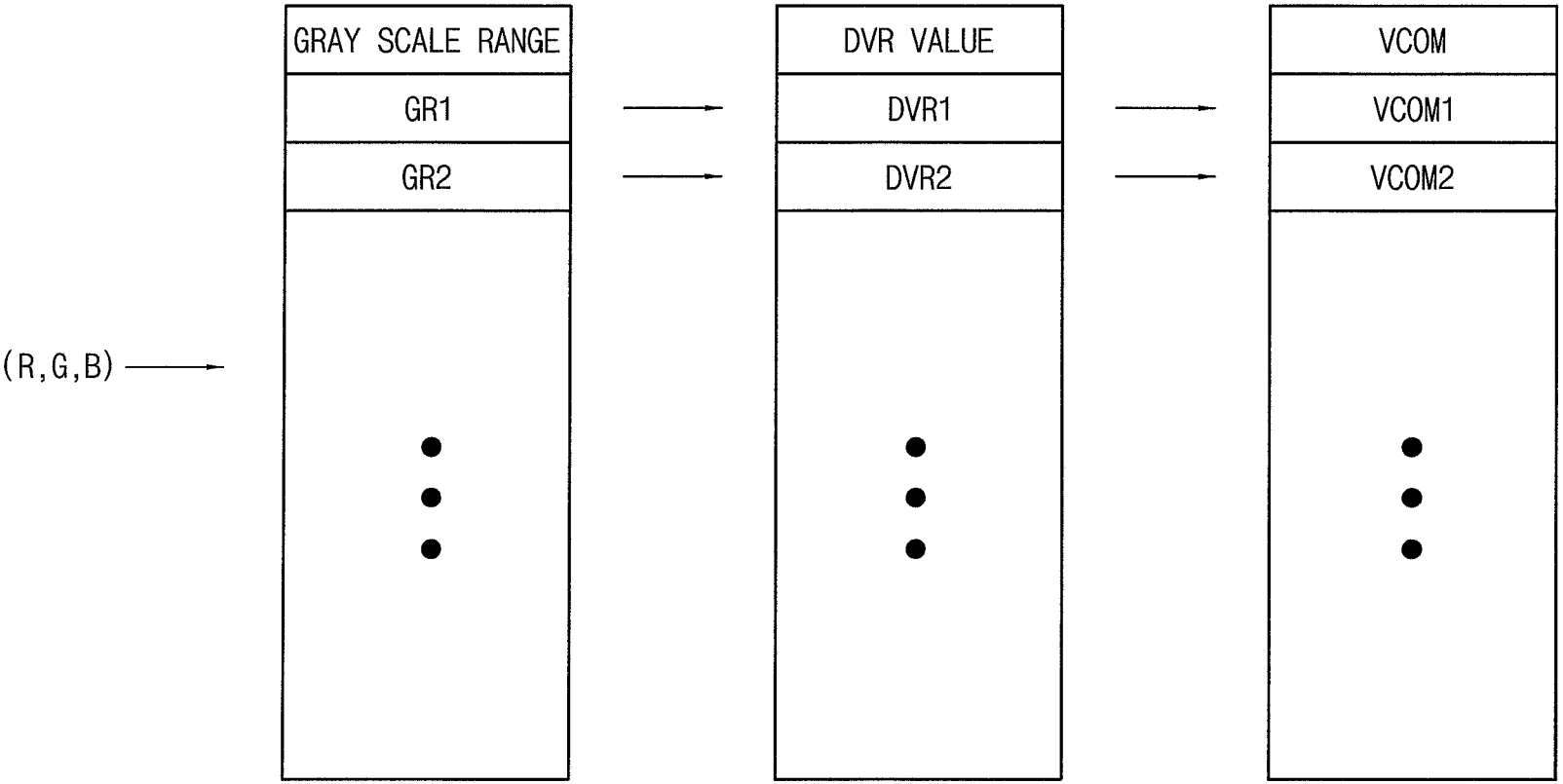
FIG. 4 is a diagram illustrating an exemplary embodiment of a step of controlling a common voltage based on a representative grayscale in a display apparatus.

FIG. 4 is a diagram illustrating a step of controlling a common voltage based on a representative grayscale in a display apparatus according to exemplary embodiments.

Referring to FIGS. 1 to 4, the timing controller 200 determines a representative grayscale (R, G, B) of each frame. The timing controller 200 may figure out which grayscale range among a plurality of grayscale ranges the representative grayscale (R, G, B) is included in. Each of the grayscale ranges may be a grayscale range for displaying a certain color. In an exemplary embodiment, each of the grayscale ranges may be a grayscale range for displaying a dark skin color, a first light skin color, a second light skin color, and so on, for example. The timing controller 200 may figure out a grayscale range in which the representative grayscale (R, G, B) is included and figure out a representative color of the frame. In an exemplary embodiment, the representative color may be the most frequent color of the frame, for example.

The timing controller 200 looks up a DVR value corresponding to the grayscale range in which the representative grayscale (R, G, B) is included. In an exemplary embodiment, the timing controller 200 may look up a first DVR value DVR1 corresponding to a first grayscale range GR1, for example. The timing controller 200 may look up a second DVR value DVR2 corresponding to a second grayscale range GR2. The timing controller 200 may store the DVR value in the form of a look-up table. The timing controller 200 updates the DVR value in each frame according to the representative grayscale (R, G, B). The timing controller 200 outputs the fourth control signal CONT4 including the DVR value to the common voltage generator 600.

The common voltage generator 600 generates the common voltage VCOM corresponding to the DVR value based on the fourth control signal CONT4. Specifically, the level of the common voltage VCOM may correspond to the DVR value. In an exemplary embodiment, the common voltage generator 600 may generate a first common voltage VCOM1 corresponding to the first DVR value DVR1, for example. The common voltage generator 600 may generate a second common voltage VCOM2 corresponding to the second DVR value DVR2.

The common voltage generator 600 may generate the common voltage VCOM satisfying an equation below:

$$VCOM = VCOM_M - \frac{DVR+1}{DVR_M+1} VCOM_R,$$

where $VCOM_M$ denotes a maximum available value of the common voltage, $VCOM_R$ denotes a variable range of the common voltage, $DVR_M$ denotes a maximum DVR value, and DVR denotes the DVR value.

The maximum available value of the common voltage $VCOM_M$ is a maximum level of the common voltage that the common voltage generator 600 is able to generate. In an exemplary embodiment, the maximum available value of the common voltage $VCOM_M$ may be between about 6.5 volts (V) and about 7.5 V, for example. The variable range of the common voltage $VCOM_R$ is a range of the common voltage that the common voltage generator 600 is able to generate. In an exemplary embodiment, the variable range of the common voltage $VCOM_R$ may be about 1 V, for example. The maximum DVR value $DVR_M$ is a maximum value that the DVR value can have. In an exemplary embodiment, the maximum DVR value $DVR_M$ may be 127, for example.

The common voltage generator 600 outputs the common voltage VCOM to the common electrode.

Figure 5B:
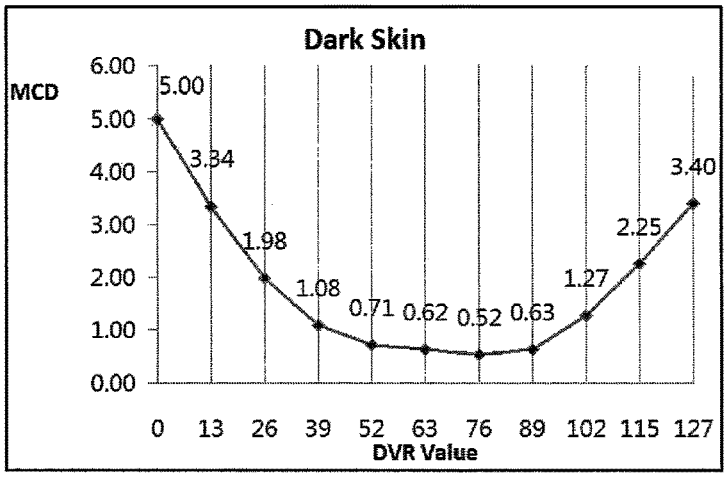
FIGS. 5B, 5C, 5D, 5E and 5F are graphs illustrating a first experimental example in FIG. 5A.
Figure 5B:
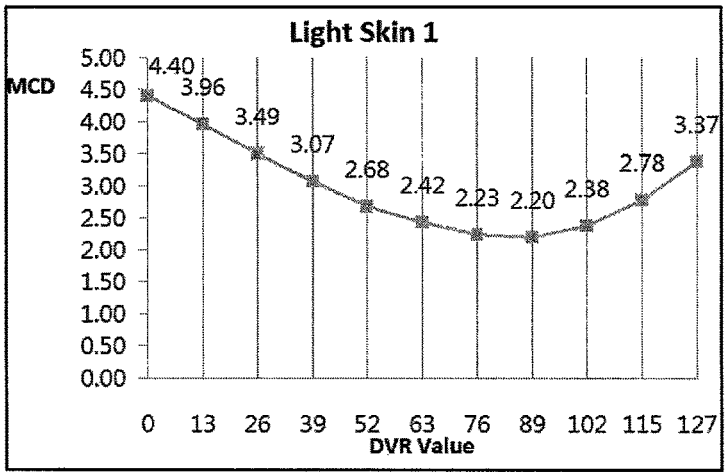
Figure 5B:
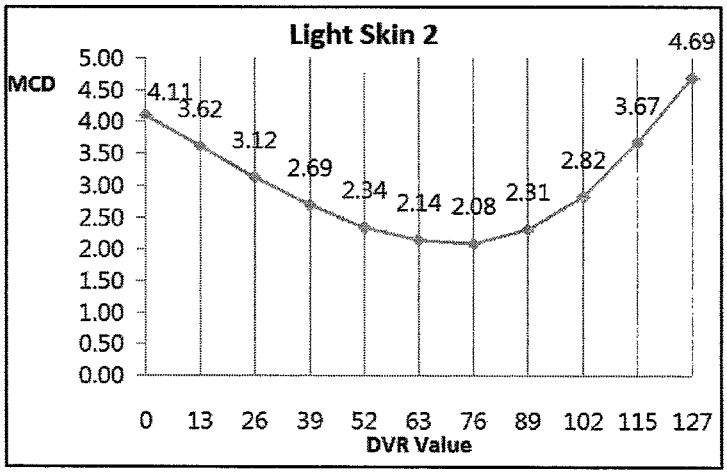
Figure 5C:
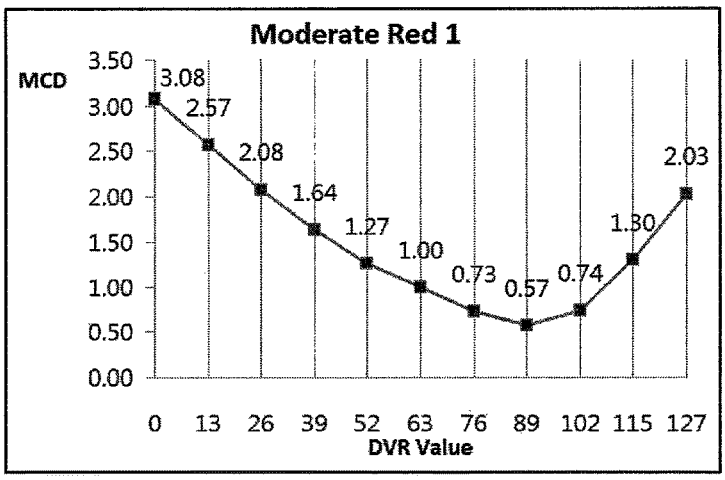
Figure 5C:
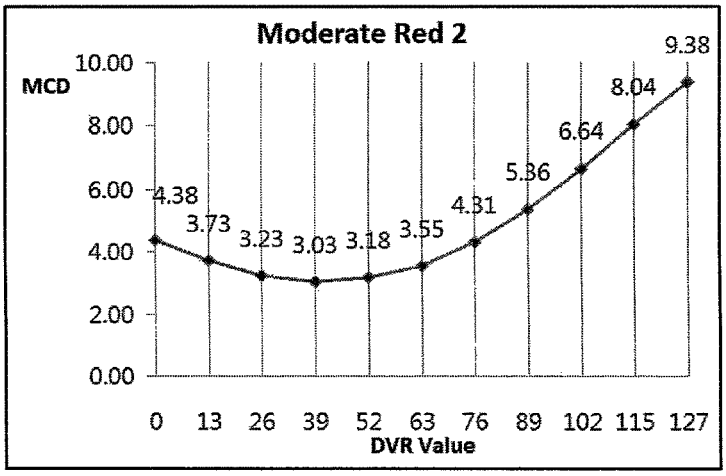
Figure 5C:
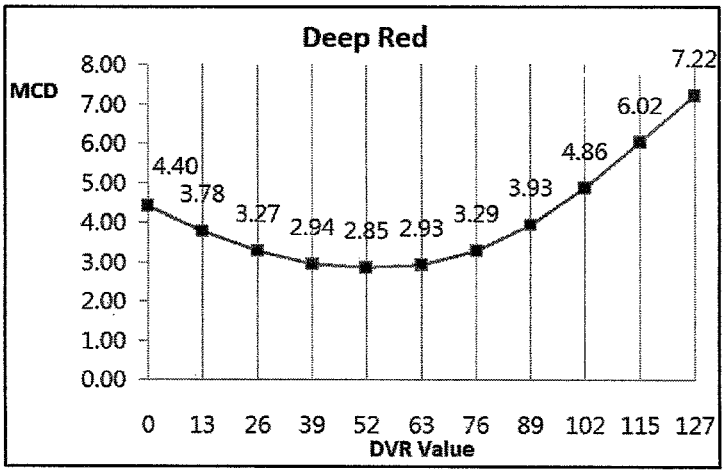
Figure 5D:
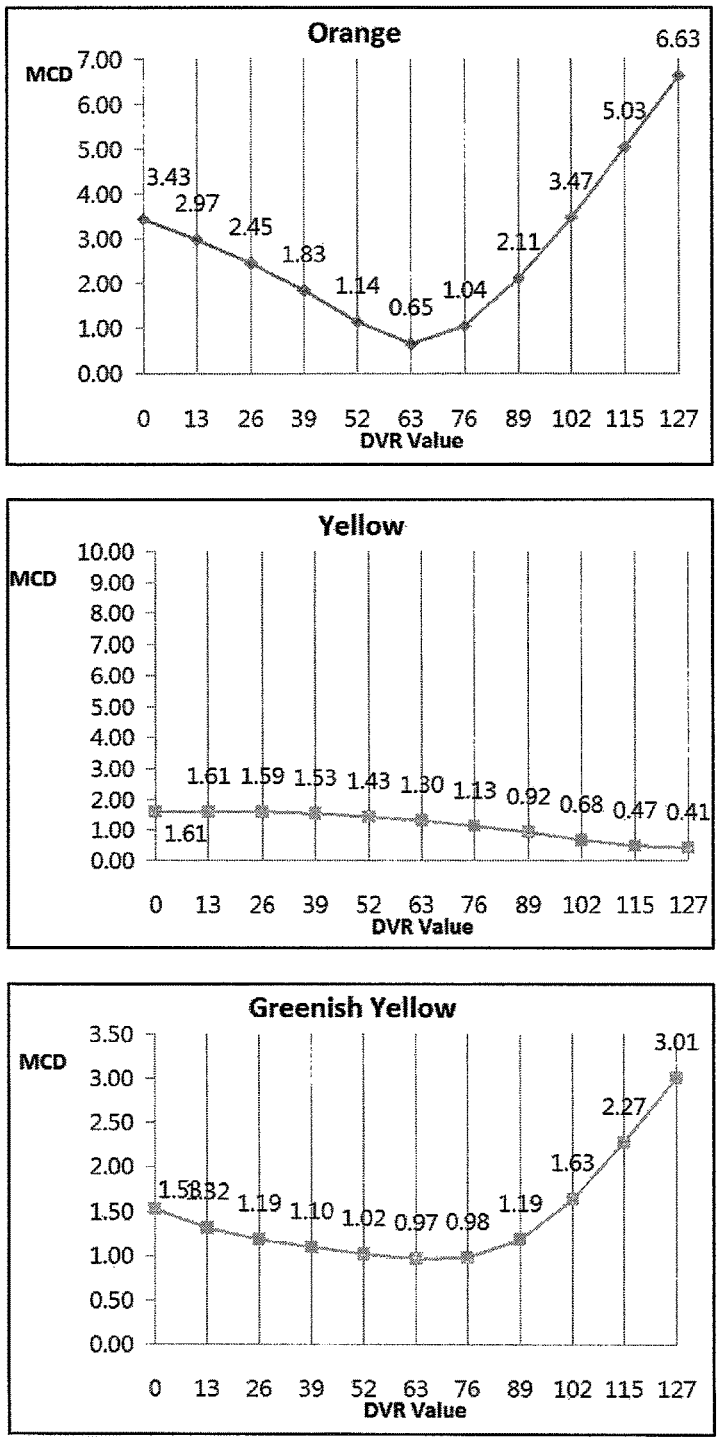
Figure 5E:
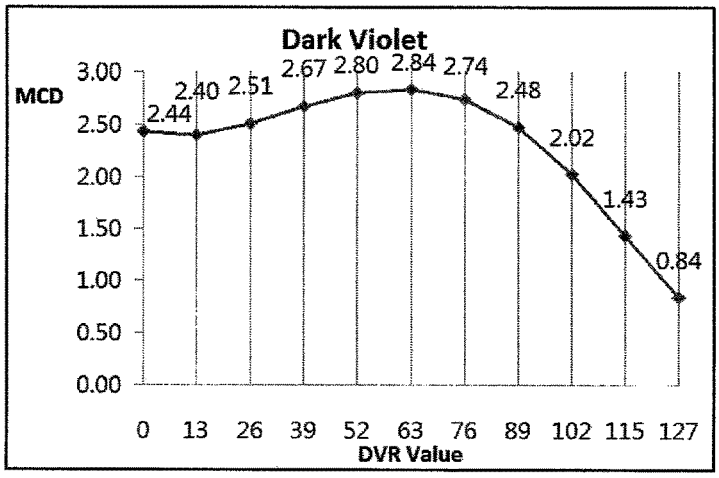
Figure 5E:
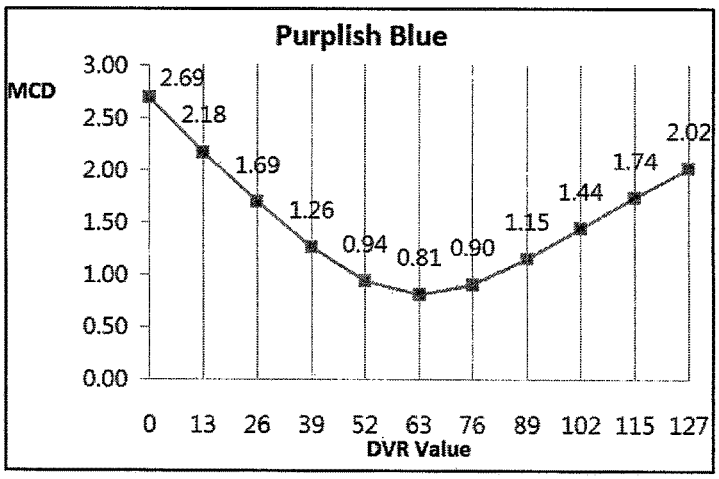
Figure 5E:
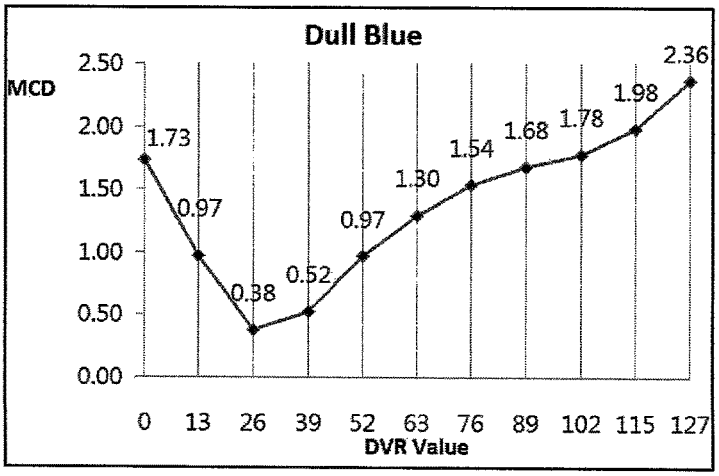
Figure 5F:
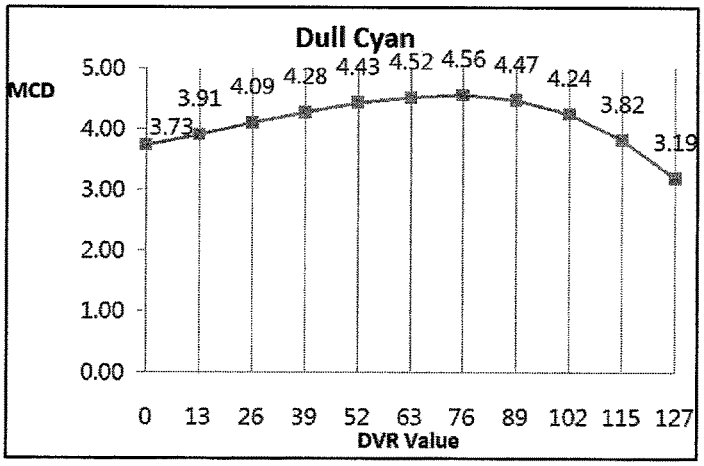
Figure 5F:
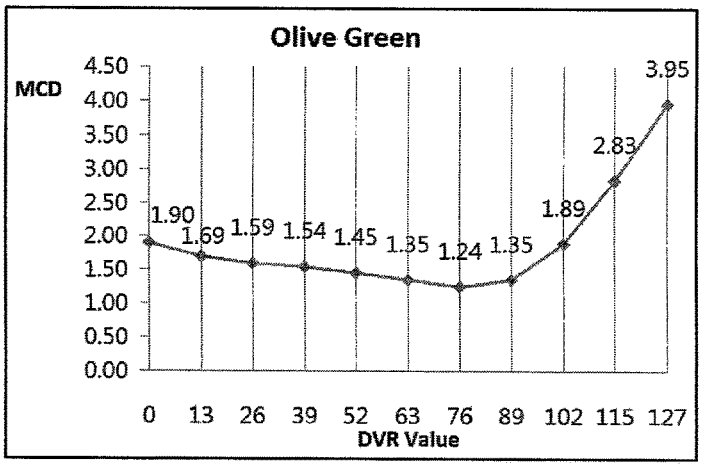
Figure 5F:
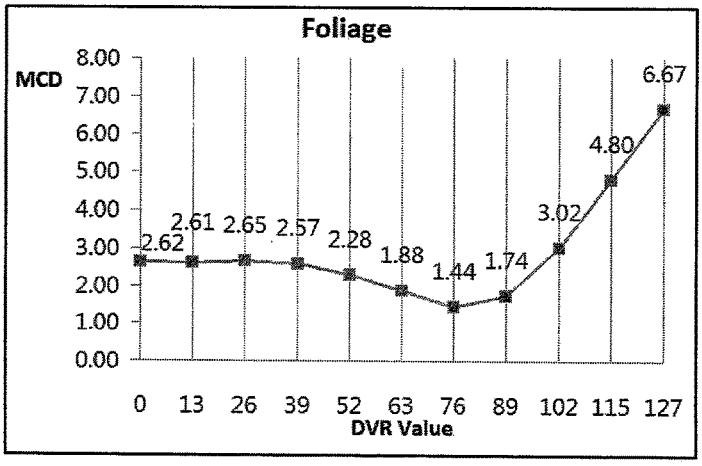
Figure 5H:
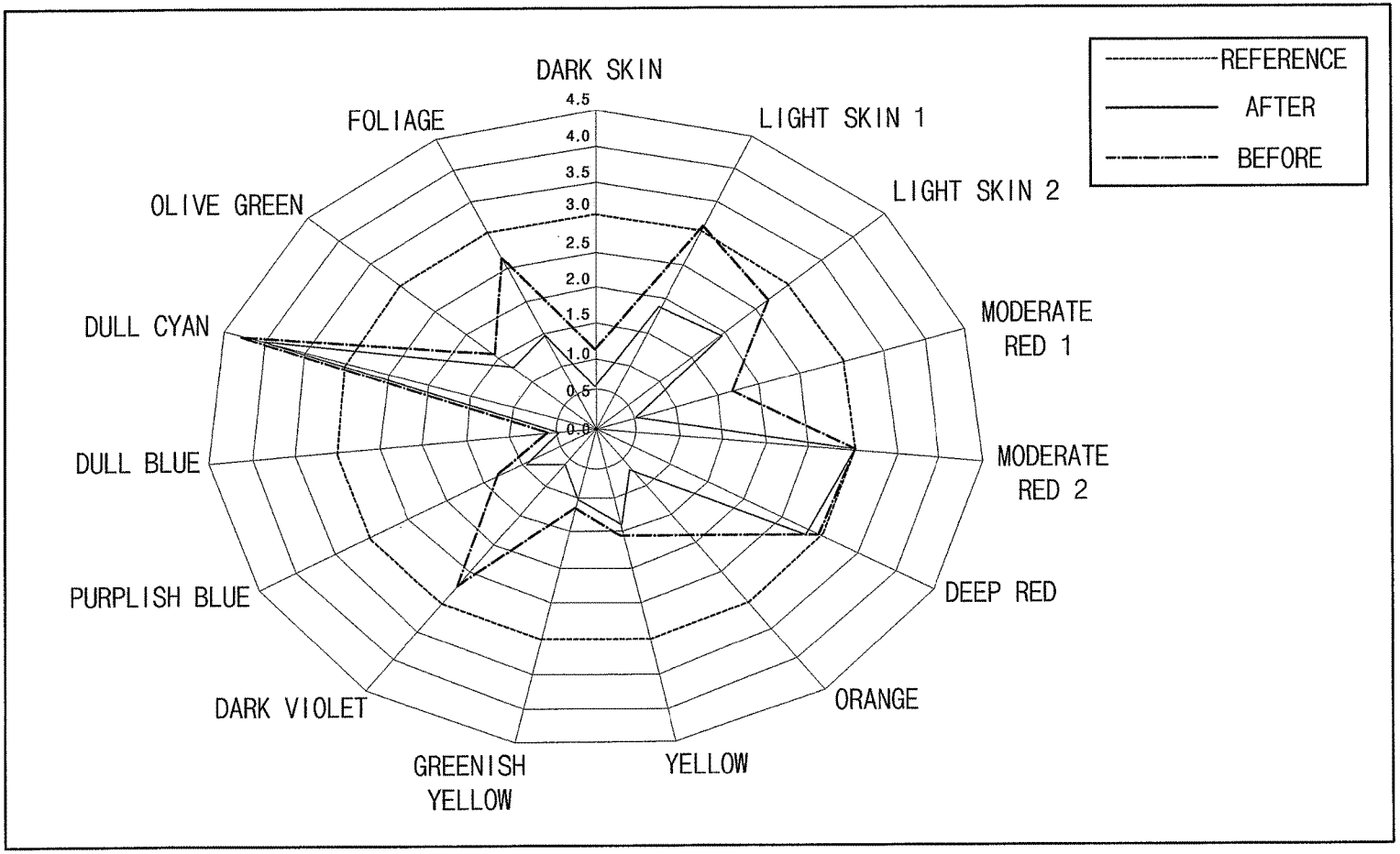
FIG. 5H is a graph illustrating an exemplary embodiment of an MCD in FIG. 5G and a reference MCD.

FIG. 5A is a table illustrating a first experimental example of a mixed color difference ("MCD") according to a DVR value of each grayscale in a display apparatus according to exemplary embodiments. FIGS. 5B, 5C, 5D, 5E and 5F are graphs illustrating a first experimental example in FIG. 5A. FIG. 5G is a table illustrating a result of comparing an MCD before and after applying an optimum DVR value in FIG. 5A. FIG. 5H is a graph illustrating an MCD in FIG. 5G and a reference MCD according to exemplary embodiments.

In the first experimental example, a 65 inch ultra high definition television ("UHD TV") of MB7 pixel structure is used, a maximum available value of a common voltage is set to about 6.55 V, a variable range of a common voltage is set to about 1 V, and a maximum DVR value is set to 127. In the MB7 pixel structure, a plurality of sub-pixels composing a unit pixel are arranged in a direction in which the data lines extend, the gate lines are connected to each of the sub-pixels, and all of the sub-pixels are connected to one data line. In other words, the MB7 pixel structure is a pixel structure where a plurality of data lines and one data line are connected to a unit pixel.

The MCD is an index indicating a difference between a color desired to display and a color actually displayed when a color is displayed in the display apparatus. A quality of display apparatus is evaluated to be higher, as the MCD is lower. A DVR value when the MCD is lowest is called a best DVR value of the color.

A reference MCD is an MCD being a judging criteria of abnormality of a color difference of the display apparatus. When the MCD is higher than the reference MCD, the display apparatus is judged to have abnormality. In an exemplary embodiment, the reference MCD may be 3.00, for example.

Referring to FIGS. 1, 4, 5A, 5B, 5C, 5D, 5E and 5F, a grayscale to display colors may be included in ±3 range of a grayscale corresponding to the colors marked in the table of FIG. 5A. Desirably, a grayscale to display colors may be the grayscale corresponding to the colors marked in the table of FIG. 5A.

In an exemplary embodiment, a grayscale range to display a dark skin color (Dark Skin) may be 91 to 97 for the red grayscale R, 25 to 31 for the green grayscale G, and 10 to 16 for the blue grayscale B, for example. Desirably, a grayscale to display the dark skin color (Dark Skin) may be 94 for the red grayscale R, 28 for the green grayscale G, and 13 for the blue grayscale B, for example. In an exemplary embodiment, the dark skin color (Dark Skin) may be used to describe a skin color of black people, for example.

In an exemplary embodiment, a grayscale range to display a first light skin color (Light Skin 1) may be 194 to 200 for the red grayscale R, 148 to 154 for the green grayscale G, and 127 to 133 for the blue grayscale B, for example. Desirably, a grayscale to display the first light skin color (Light Skin 1) may be 197 for the red grayscale R, 151 for the green grayscale G, and 130 for the blue grayscale B, for example. In an exemplary embodiment, the first light skin color (Light Skin 1) may be used to describe a skin color of white people, for example.

In an exemplary embodiment, a grayscale range to display a second light skin color (Light Skin 2) may be 238 to 244 for the red grayscale R, 146 to 152 for the green grayscale G, and 105 to 111 for the blue grayscale B, for example. Desirably, a grayscale to display the second light skin color (Light Skin 2) may be 241 for the red grayscale R, 149 for the green grayscale G, and 108 for the blue grayscale B, for example. In an exemplary embodiment, the second light skin color (Light Skin 2) may be used to describe a skin color of yellow people, for example.

In addition, to display the other colors marked in the table of FIG. 5A, substantially the same method may be used.

When an input grayscale (R, G, B) is (94, 28, 13) displaying the dark skin color (Dark Skin), for example, the MCD is lower than the reference MCD of 3.00 when the DVR value is 26 to 115. Especially, the MCD is lowest when the DVR value is 64 to 88, for example. Desirably, the MCD has the minimum value of 0.52 when the DVR value is 76, for example. In other words, a best DVR value of the dark skin color (Dark Skin) is 76. A common voltage according to the best DVR value is about 5.95 V, for example.

When an input grayscale (R, G, B) is (197, 151, 130) displaying the first light skin color (Light Skin 1), for example, the MCD is lower than the reference MCD of 3.00 when the DVR value is 52 to 115. Especially, the MCD is lowest when the DVR value is 77 to 101, for example. Desirably, the MCD has the minimum value of 2.20 when the DVR value is 89. In other words, a best DVR value of the first light skin color (Light Skin 1) is 89, for example. A common voltage according to the best DVR value is about 5.85 V, for example.

When an input grayscale (R, G, B) is (241, 149, 108) displaying the second light skin color (Light Skin 2), for example, the MCD is lower than the reference MCD of 3.00 when the DVR value is 39 to 102. Especially, the MCD is lowest when the DVR value is 64 to 88, for example. Desirably, the MCD has the minimum value of 2.08 when the DVR value is 76, for example. In other words, a best DVR value of the second light skin color (Light Skin 2) is 76, for example. A common voltage according to the best DVR value is about 5.95 V, for example.

In addition, substantially the same method may be used to the other colors marked in the table of FIG. 5A to obtain a DVR value range where the MCD is lower than the reference MCD of 3.00, a DVR value range where the MCD is lowest, a best DVR value, and a common voltage according to the best DVR value.

Referring to FIG. 5G, the table shows MCDs when the DVR value is 39 in case of not applying exemplary embodiments of the invention (BEFORE), MCDs when the DVR value is the best DVR value in FIG. 5A in case of applying exemplary embodiments of the invention (AFTER), and variations between the MCDs (BEFORE) and the MCDs (AFTER). For all of the colors marked in FIG. 5G, the MCDs (AFTER) is lower than the MCDs (BEFORE). Especially, for the first light skin color (Light Skin 1), the MCD (BEFORE) is 3.07 which is higher than the reference MCD of 3.00, but the MCD (AFTER) is 1.84 which is much lower than the reference MCD of 3.00.

Referring to FIG. 5H, a graph of the MCD (AFTER) marked as a solid line is located inside of a graph of the MCD (BEFORE) marked as a dashed dotted line.

Figure 6B:
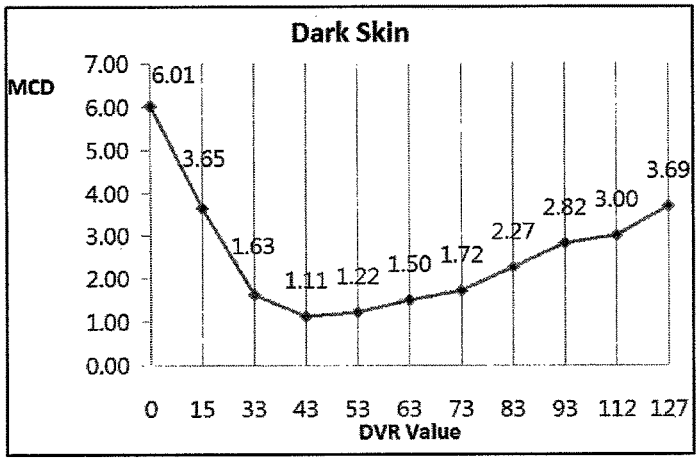
FIGS. 6B, 6C, 6D, 6E and 6F are graphs illustrating a second experimental example in FIG. 6A.
Figure 6B:
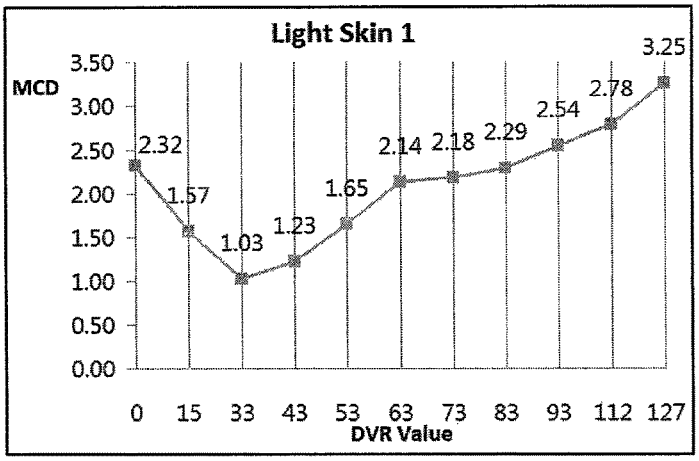
Figure 6B:
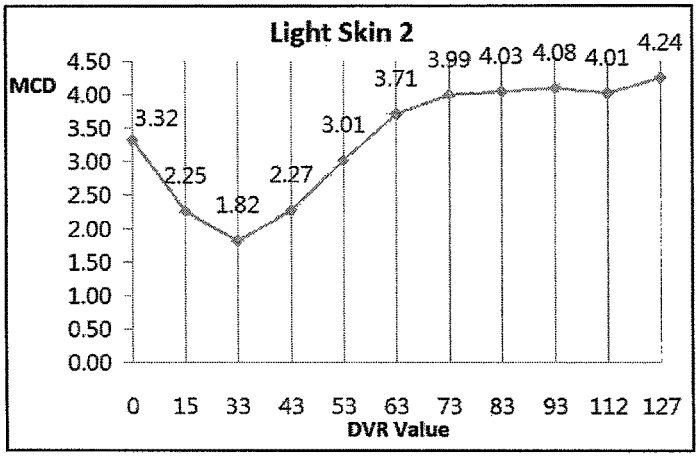
Figure 6C:
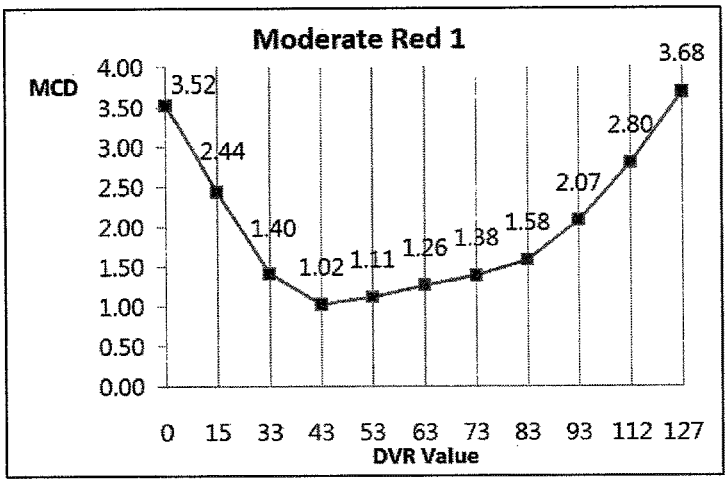
Figure 6C:
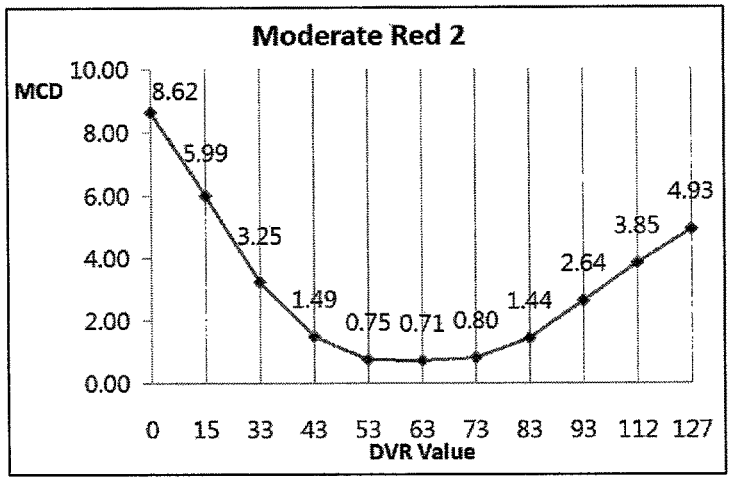
Figure 6C:
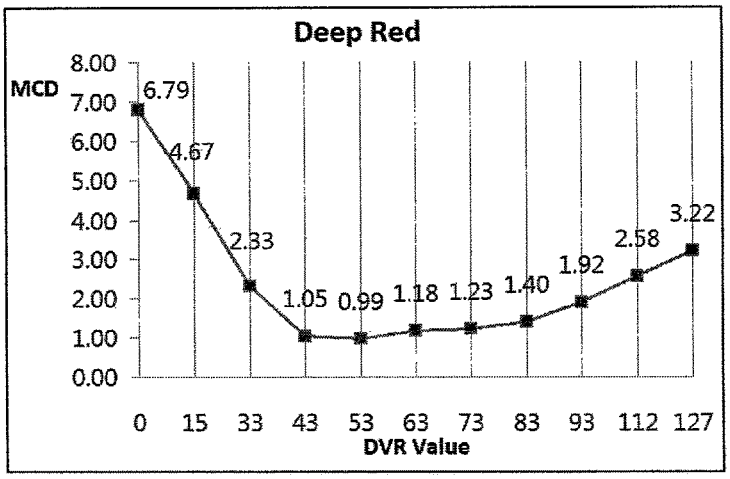
Figure 6D:
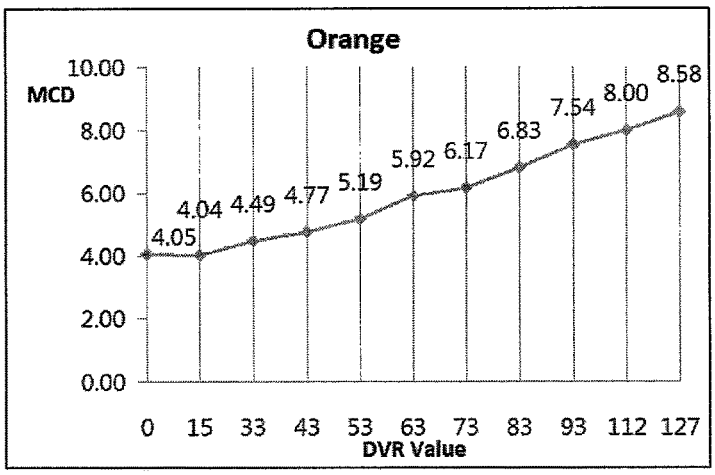
Figure 6D:
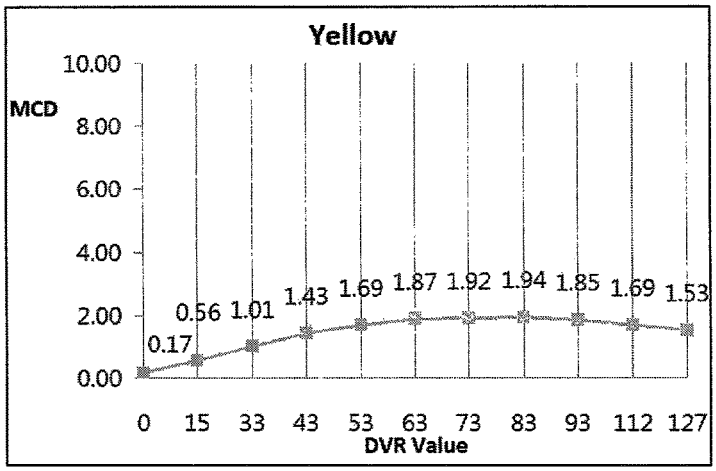
Figure 6D:
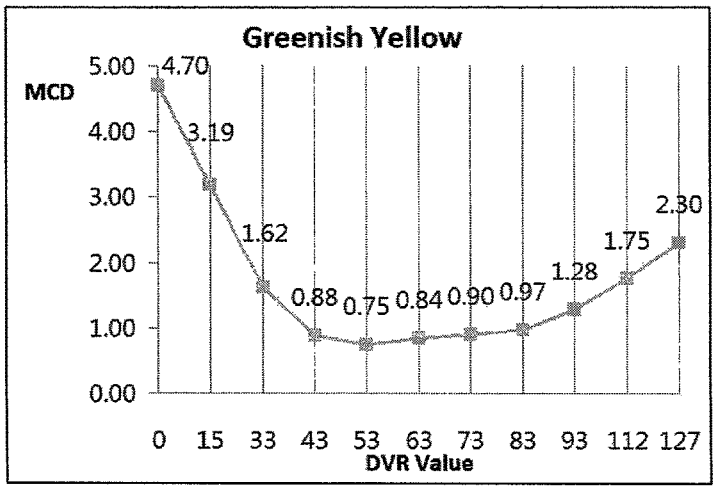
Figure 6E:
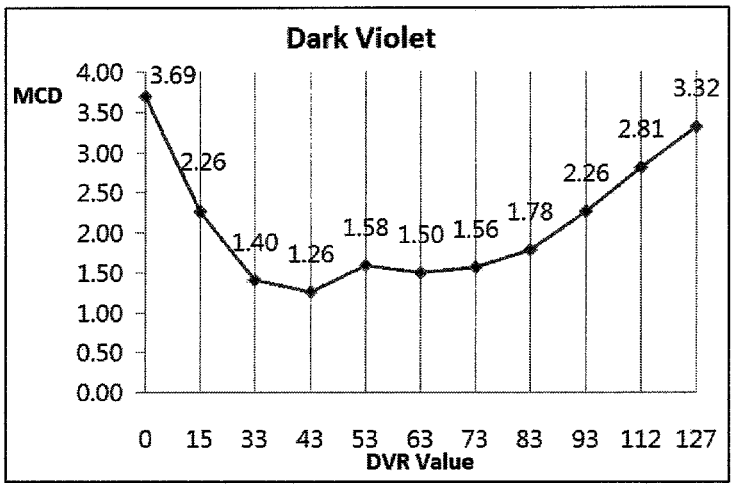
Figure 6E:
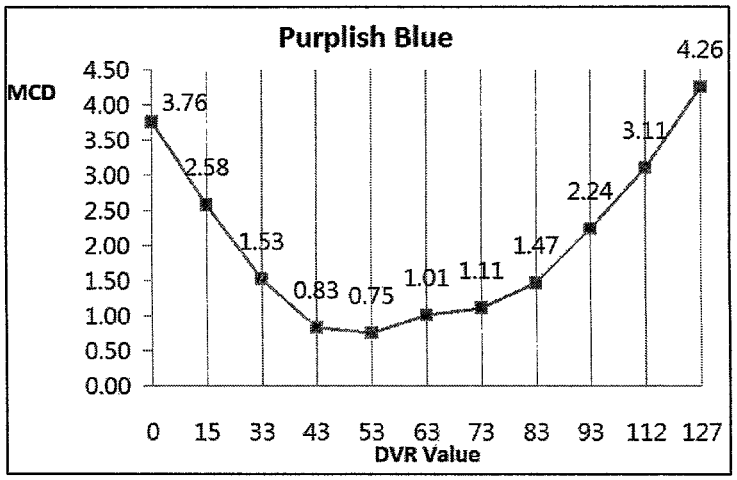
Figure 6E:
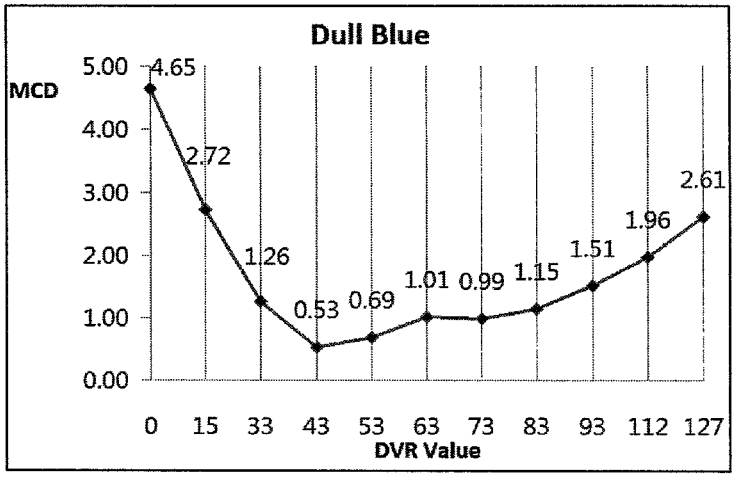
Figure 6F:
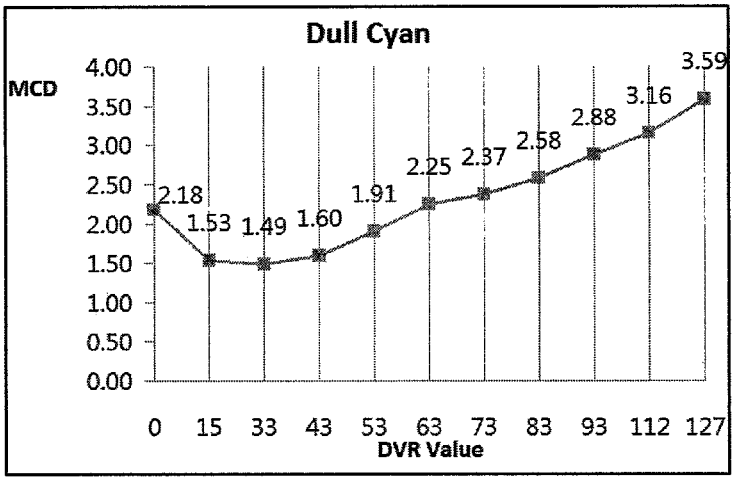
Figure 6F:
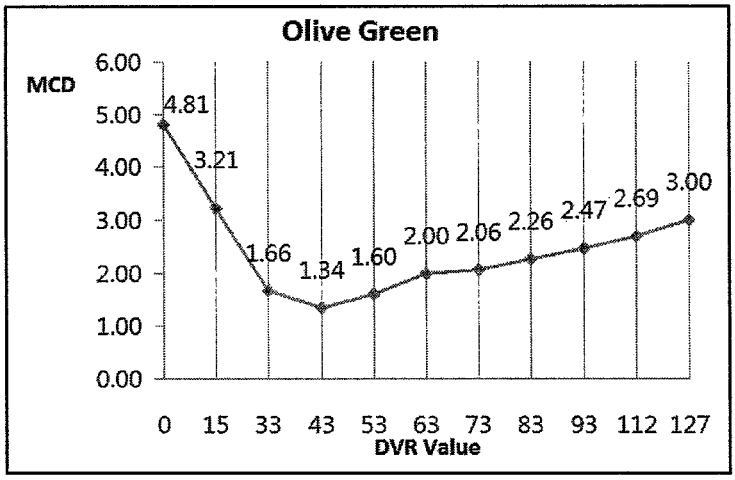
Figure 6F:
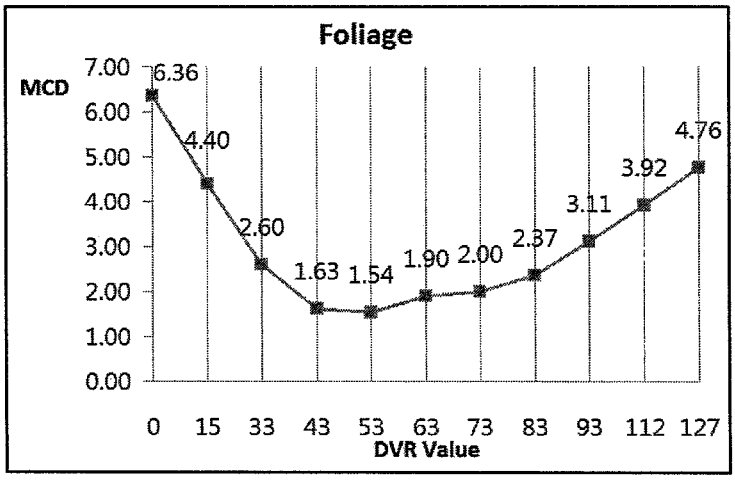

FIG. 6A is a table illustrating a second experimental example of an MCD according to a DVR value of each grayscale in a display apparatus according to exemplary embodiments. FIGS. 6B, 6C, 6D, 6E and 6F are graphs illustrating a second experimental example in FIG. 6A. Hereinafter, any repetitive explanation concerning FIGS. 5A, 5B, 5C, 5D, 5E and 5F will be omitted.

In the second experimental example, a 55 inch UHD TV of MB7 pixel structure is used, and a maximum DVR value is set to 127, for example.

Referring to FIGS. 1, 4, 6A, 6B, 6C, 6D, 6E and 6F, when an input grayscale (R, G, B) is (94, 28, 13) displaying the dark skin color (Dark Skin), the MCD is lower than the reference MCD of 3.00 when the DVR value is 33 to 93, for example. Especially, the MCD is lowest when the DVR value is 34 to 52, for example. Desirably, the MCD has the minimum value of 1.11 when the DVR value is 43, for example. In other words, a best DVR value of the dark skin color (Dark Skin) is 43, for example.

When an input grayscale (R, G, B) is (197, 151, 130) displaying the first light skin color (Light Skin 1), the MCD is lower than the reference MCD of 3.00 when the DVR value is 0 to 112, for example. Especially, the MCD is lowest when the DVR value is 16 to 42, for example. Desirably, the MCD has the minimum value of 1.03 when the DVR value is 33, for example. In other words, a best DVR value of the first light skin color (Light Skin 1) is 33, for example.

When an input grayscale (R, G, B) is (241, 149, 108) displaying the second light skin color (Light Skin 2), the MCD is lower than the reference MCD of 3.00 when the DVR value is 15 to 43, for example. Especially, the MCD is lowest when the DVR value is 16 to 42, for example. Desirably, the MCD has the minimum value of 1.82 when the DVR value is 33, for example. In other words, a best DVR value of the second light skin color (Light Skin 2) is 33, for example.

In addition, substantially the same method may be used to the other colors marked in the table of FIG. 6A to obtain a DVR value range where the MCD is lower than the reference MCD of 3.00, a DVR value range where the MCD is lowest, a best DVR value, and a common voltage according to the best DVR value.

Figure 7B:
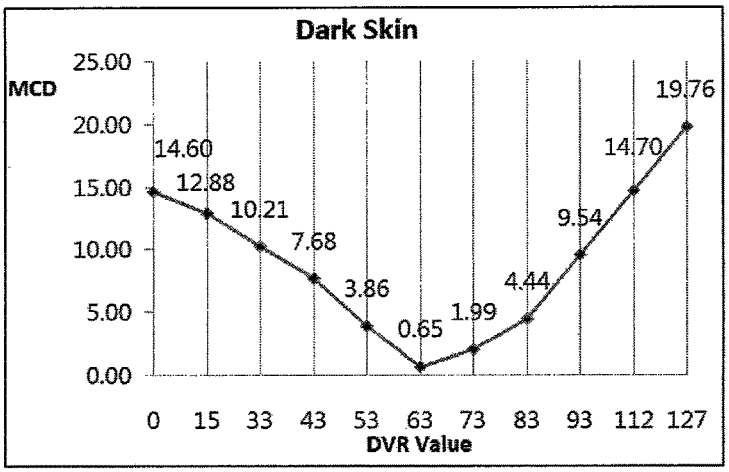
FIGS. 7B, 7C, 7D, 7E and 7F are graphs illustrating a third experimental example in FIG. 7A.
Figure 7B:
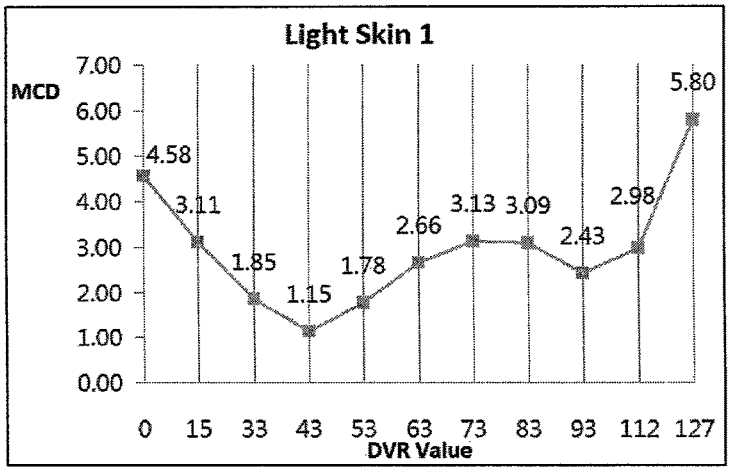
Figure 7B:
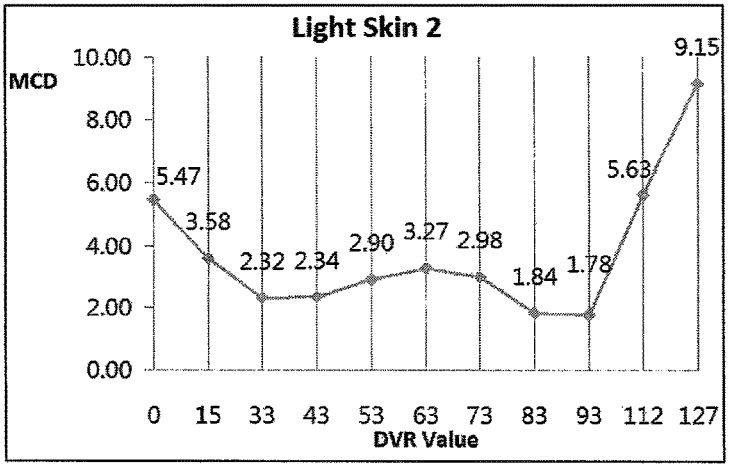
Figure 7C:
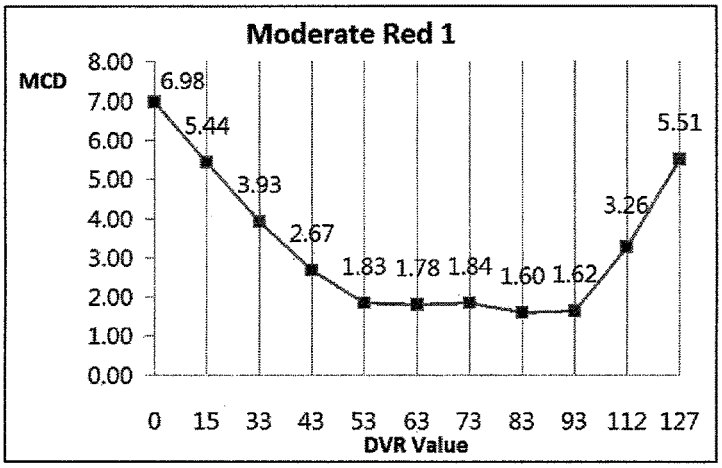
Figure 7C:
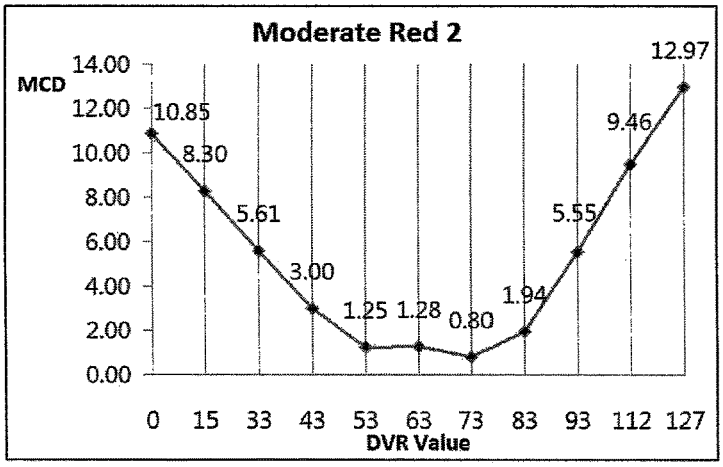
Figure 7C:
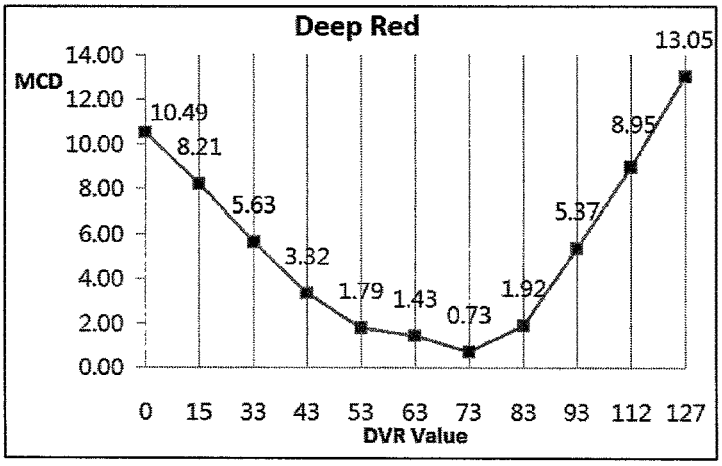
Figure 7D:
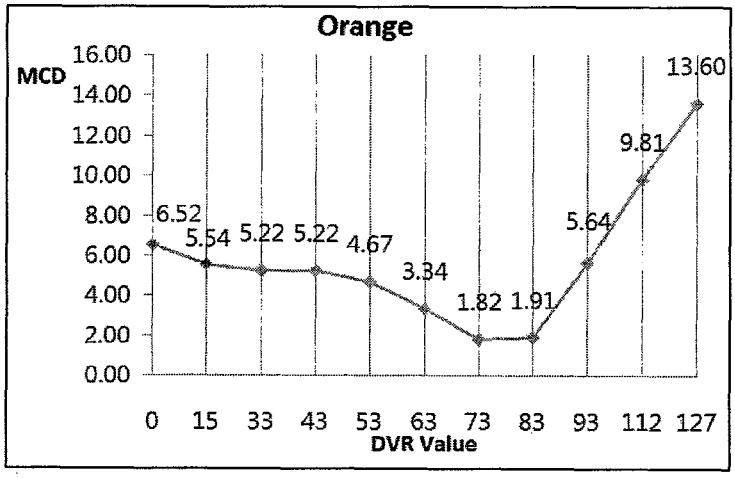
Figure 7D:
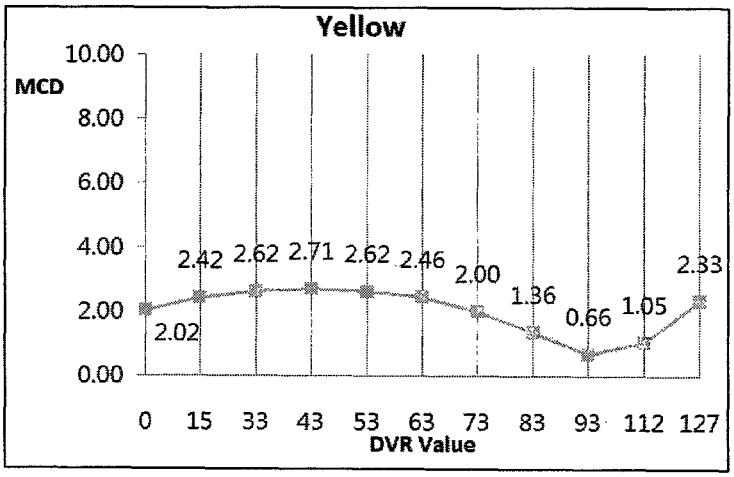
Figure 7D:
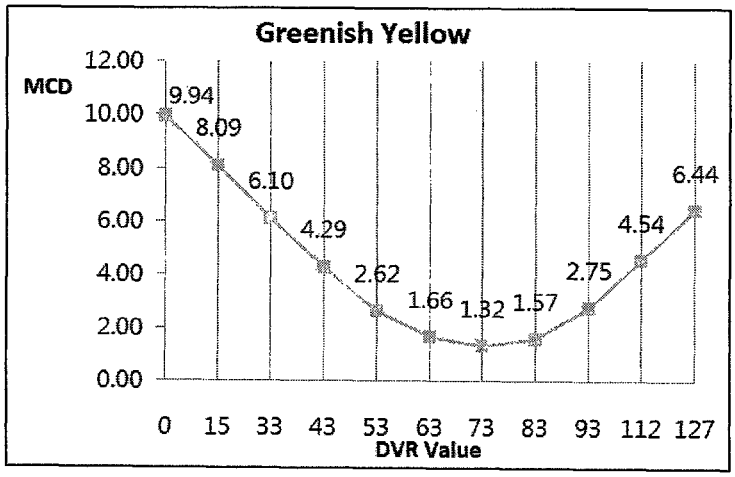
Figure 7E:
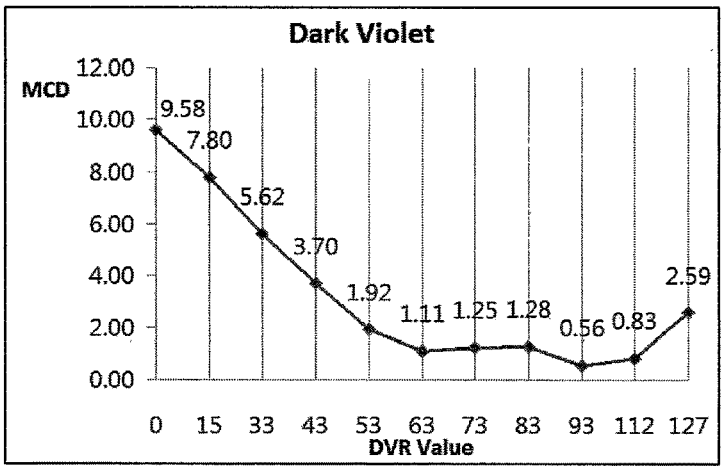
Figure 7E:
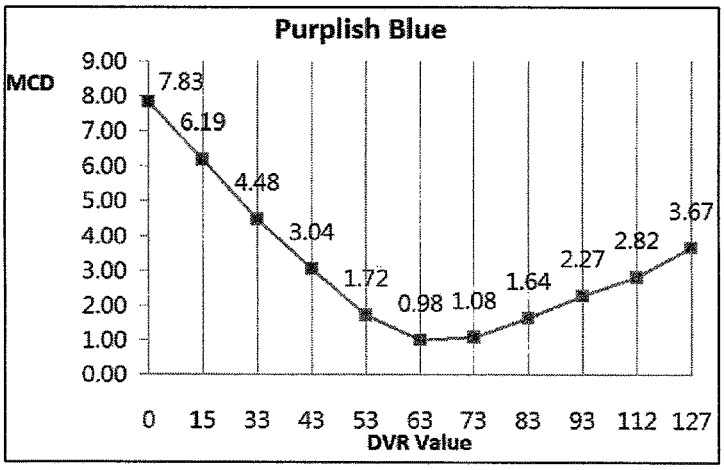
Figure 7E:
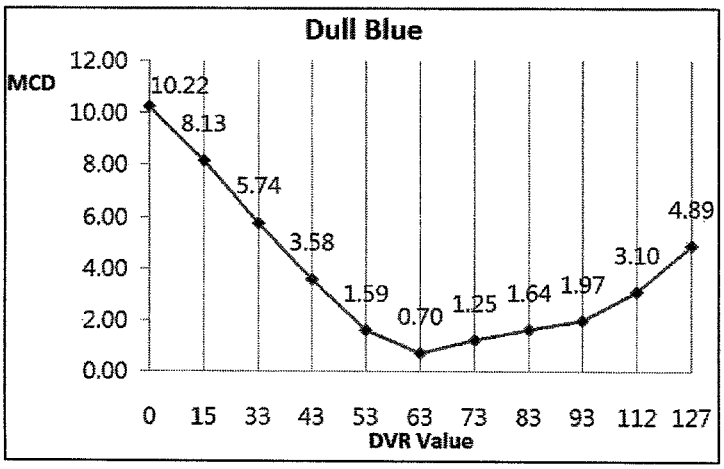
Figure 7F:
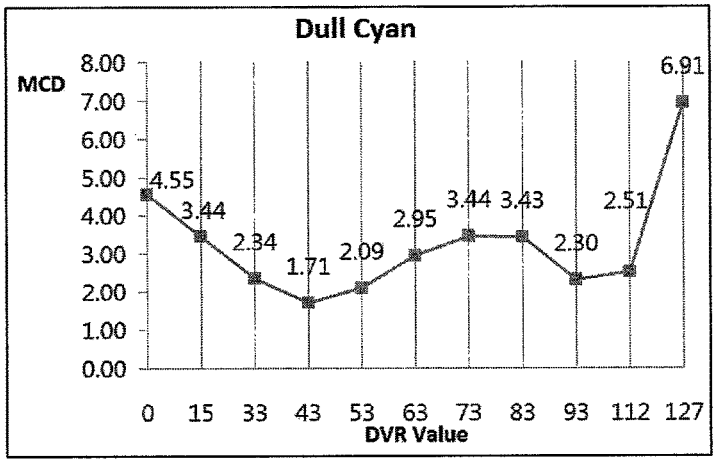
Figure 7F:
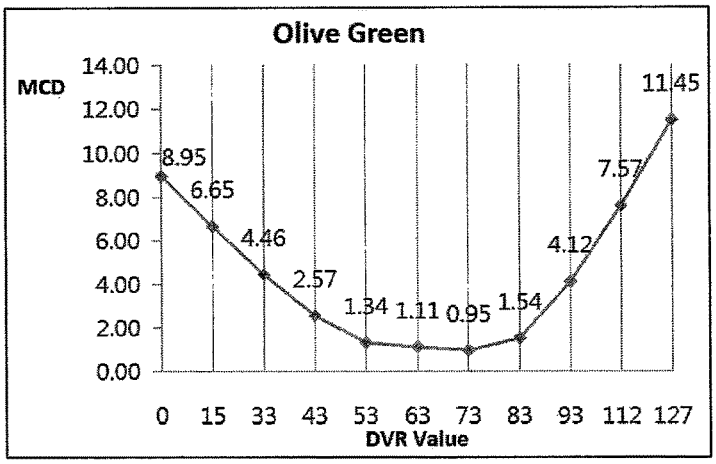
Figure 7F:
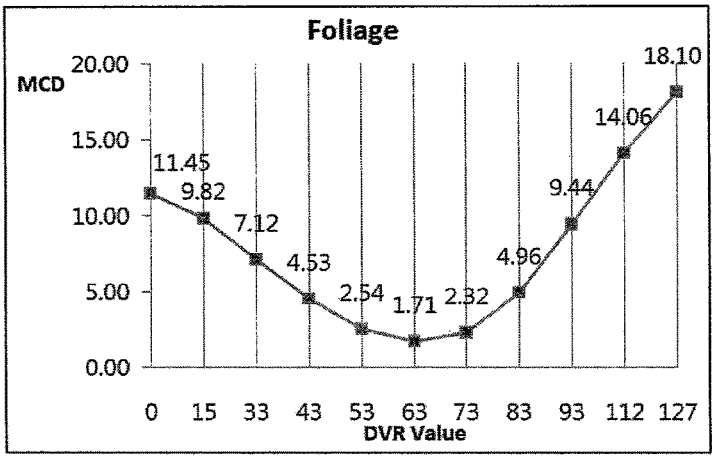

FIG. 7A is a table illustrating a third experimental example of an MCD according to a DVR value of each grayscale in a display apparatus according to exemplary embodiments. FIGS. 7B, 7C, 7D, 7E and 7F are graphs illustrating a third experimental example in FIG. 7A. Hereinafter, any repetitive explanation concerning FIGS. 5A, 5B, 5C, 5D, 5E and 5F will be omitted.

In the third experimental example, a 49 inch UHD TV of MB7 pixel structure is used, and a maximum DVR value is set to 127.

Referring to FIGS. 1, 4, 7A, 7B, 7C, 7D, 7E and 7F, when an input grayscale (R, G, B) is (94, 28, 13) displaying the dark skin color (Dark Skin), the MCD is lower than the reference MCD of 3.00 when the DVR value is 63 to 73. Especially, the MCD is lowest when the DVR value is 63 to 72. Desirably, the MCD has the minimum value of 0.65 when the DVR value is 63. In other words, a best DVR value of the dark skin color (Dark Skin) is 63.

When an input grayscale (R, G, B) is (197, 151, 130) displaying the first light skin color (Light Skin 1), the MCD is lower than the reference MCD of 3.00 when the DVR value is 33 to 63 and 93 to 112. Especially, the MCD is lowest when the DVR value is 34 to 52. Desirably, the MCD has the minimum value of 1.15 when the DVR value is 43. In other words, a best DVR value of the first light skin color (Light Skin 1) is 43.

When an input grayscale (R, G, B) is (241, 149, 108) displaying the second light skin color (Light Skin 2), the MCD is lower than the reference MCD of 3.00 when the DVR value is 33 to 53 and 73 to 93. Especially, the MCD is lowest when the DVR value is 84 to 93. Desirably, the MCD has the minimum value of 1.78 when the DVR value is 93. In other words, a best DVR value of the second light skin color (Light Skin 2) is 93.

In addition, substantially the same method may be used to the other colors marked in the table of FIG. 7A to obtain a DVR value range where the MCD is lower than the reference MCD of 3.00, a DVR value range where the MCD is lowest, a best DVR value, and a common voltage according to the best DVR value.

Figure 8B:
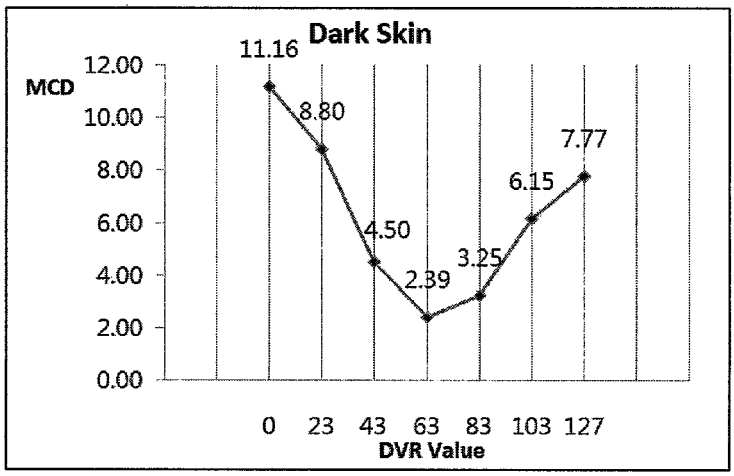
FIGS. 8B, 8C, 8D, 8E and 8F are graphs illustrating a fourth experimental example in FIG. 8A.
Figure 8B:
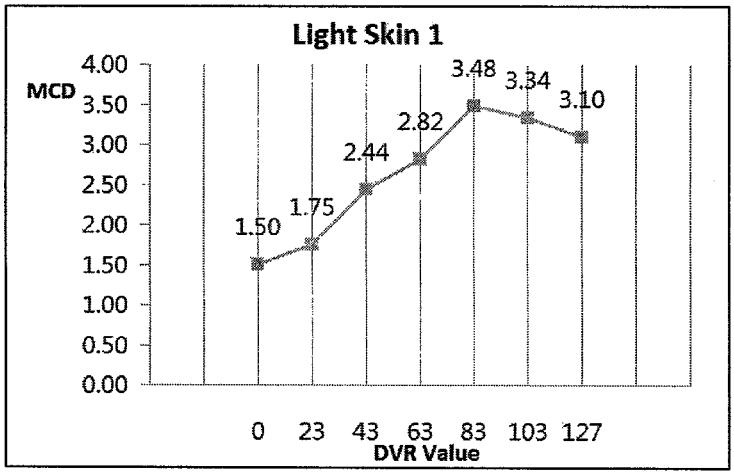
Figure 8B:
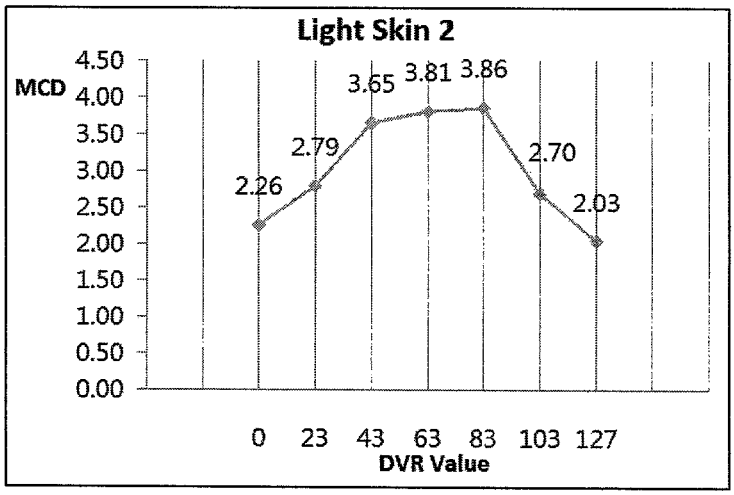
Figure 8C:
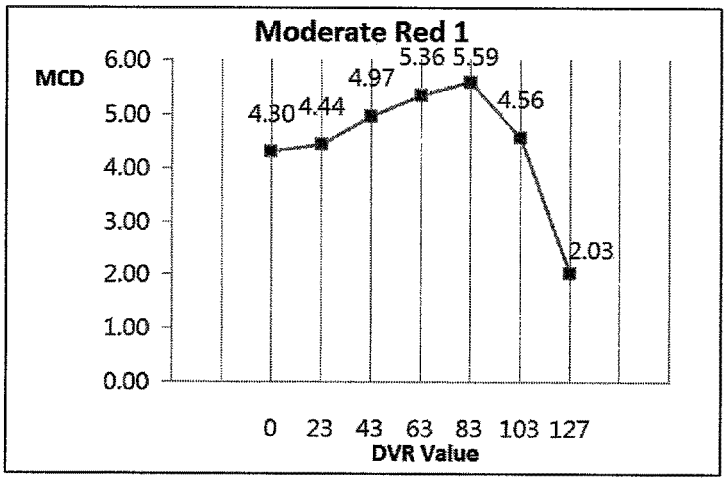
Figure 8C:
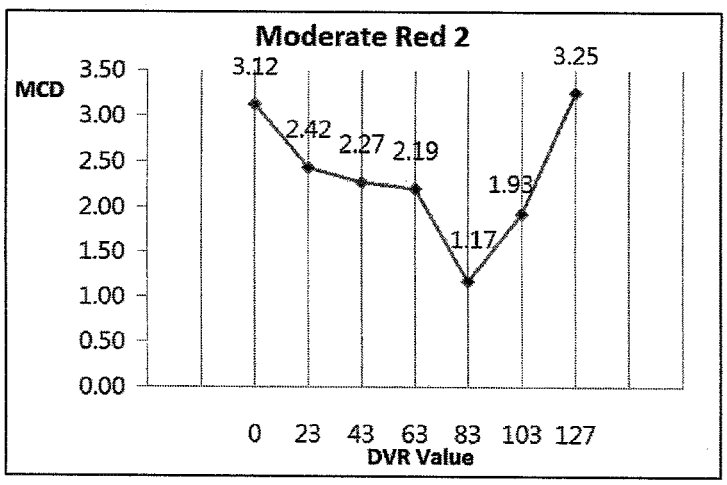
Figure 8C:
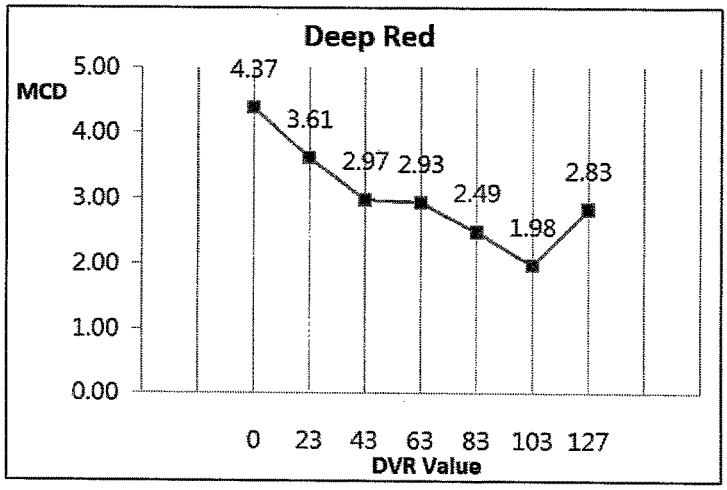
Figure 8D:
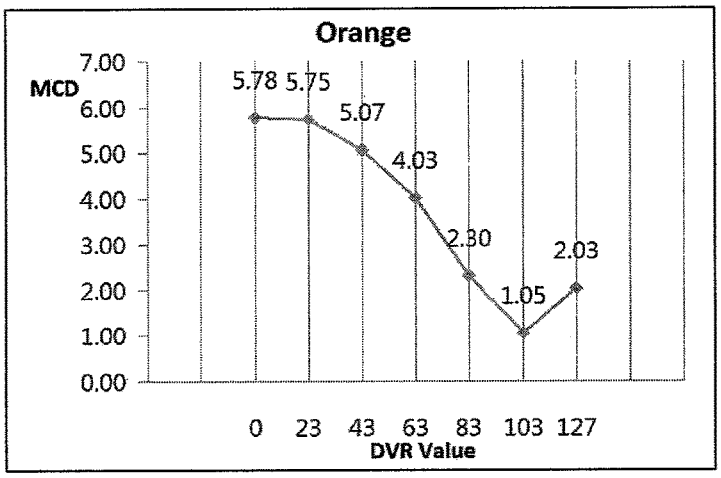
Figure 8D:
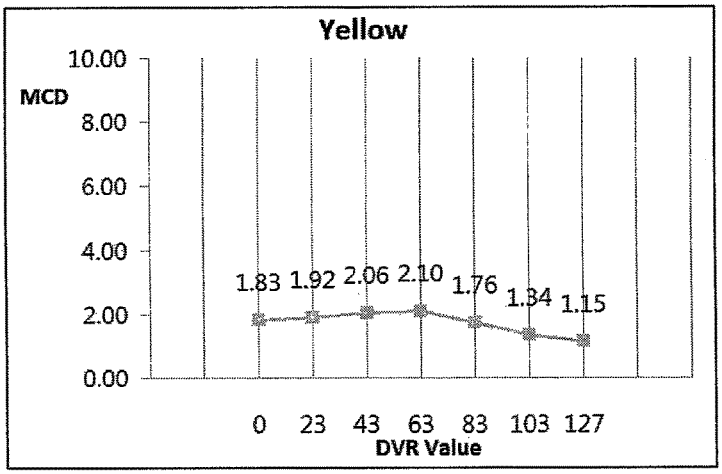
Figure 8D:
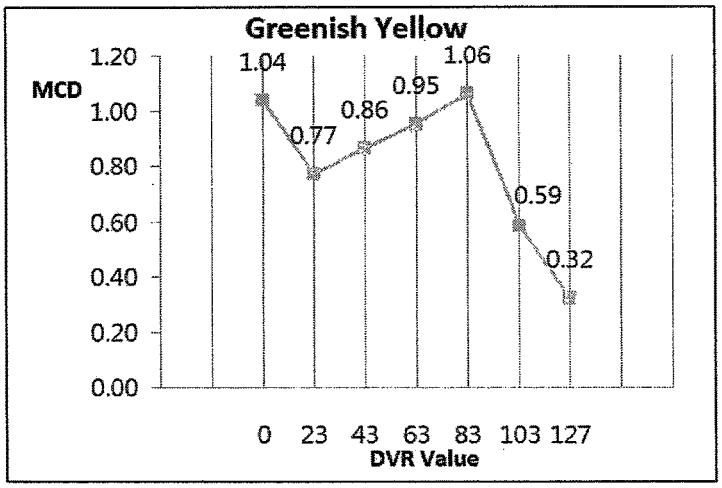
Figure 8E:
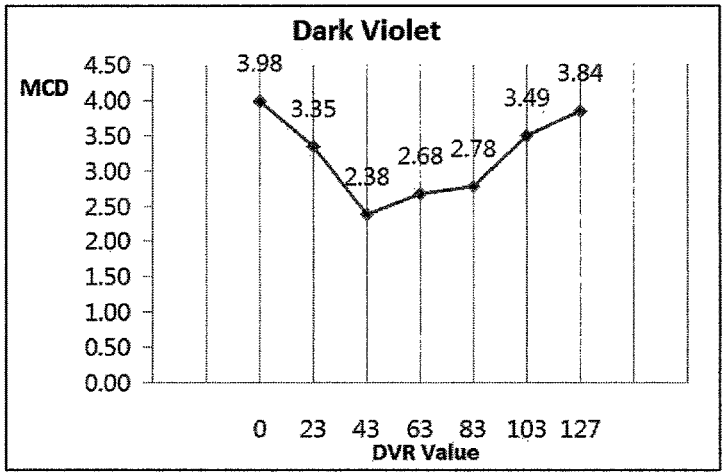
Figure 8E:
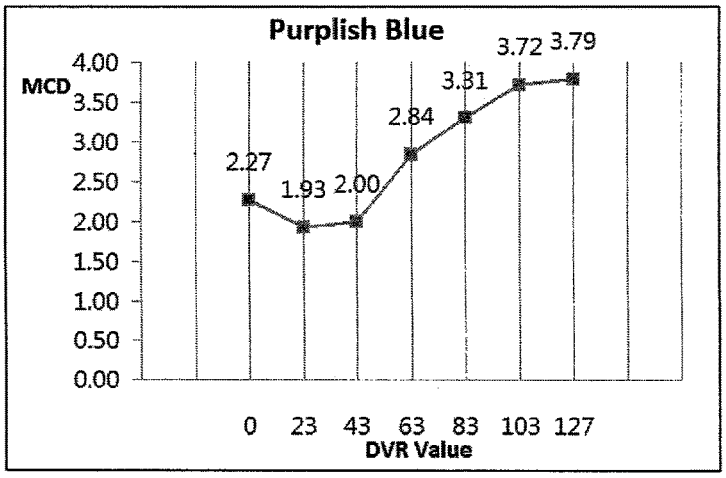
Figure 8E:
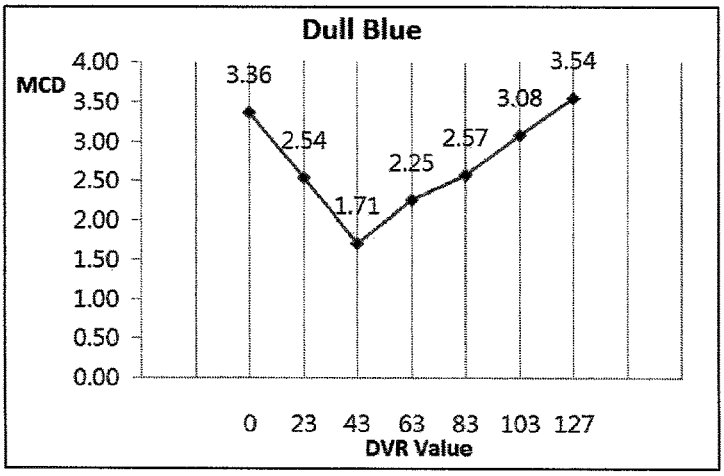
Figure 8F:
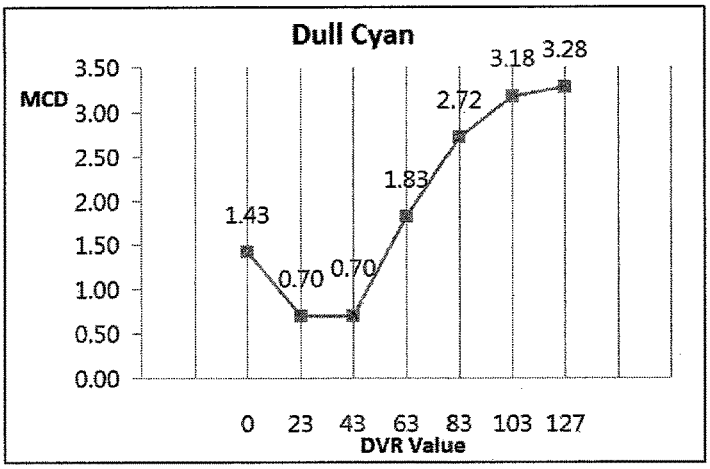
Figure 8F:
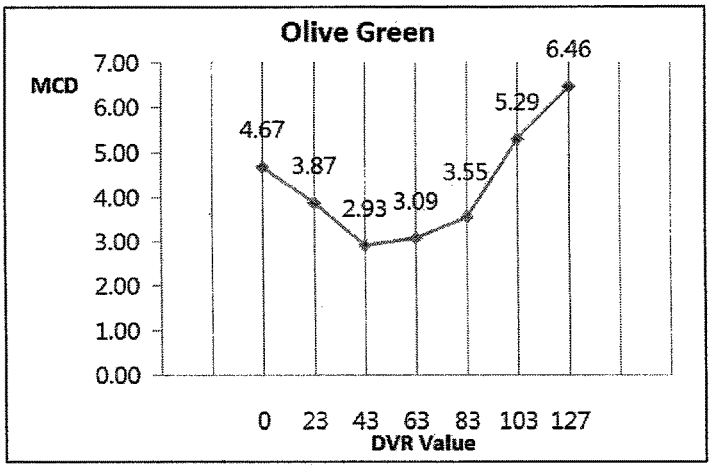
Figure 8F:
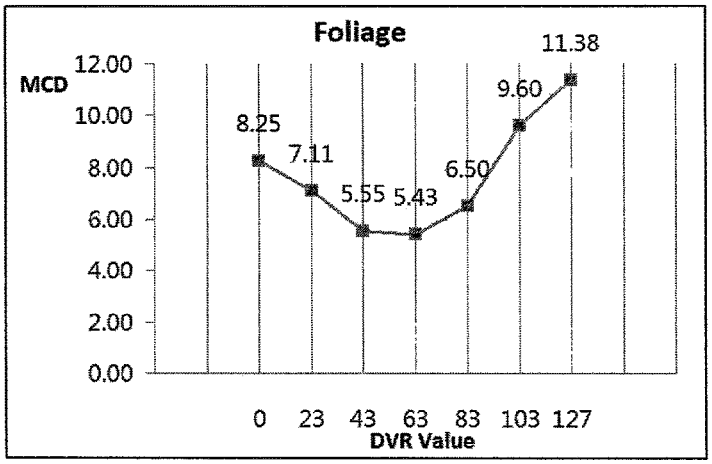

FIG. 8A is a table illustrating a fourth experimental example of an MCD according to a DVR value of each grayscale in a display apparatus according to exemplary embodiments. FIGS. 8B, 8C, 8D, 8E and 8F are graphs illustrating a fourth experimental example in FIG. 8A. Hereinafter, any repetitive explanation concerning FIGS. 5A, 5B, 5C, 5D, 5E and 5F will be omitted.

In the fourth experimental example, a 40 inch UHD TV of MB7 pixel structure is used, and a maximum DVR value is set to 127.

Referring to FIGS. 1, 4, 8A, 8B, 8C, 8D, 8E and 8F, when an input grayscale (R, G, B) is (94, 28, 13) displaying the dark skin color (Dark Skin), the MCD has the minimum value of 2.39 when the DVR value is 63. In other words, a best DVR value of the dark skin color (Dark Skin) is 63.

When an input grayscale (R, G, B) is (197, 151, 130) displaying the first light skin color (Light Skin 1), the MCD is lower than the reference MCD of 3.00 when the DVR value is 0 to 63. Especially, the MCD is lowest when the DVR value is 0 to 22. Desirably, the MCD has the minimum value of 1.50 when the DVR value is 0. In other words, a best DVR value of the first light skin color (Light Skin 1) is 0.

When an input grayscale (R, G, B) is (241, 149, 108) displaying the second light skin color (Light Skin 2), the MCD is lower than the reference MCD of 3.00 when the DVR value is 0 to 23 and 103 to 127. Especially, the MCD is lowest when the DVR value is 104 to 127. Desirably, the MCD has the minimum value of 2.03 when the DVR value is 127. In other words, a best DVR value of the second light skin color (Light Skin 2) is 127.

In addition, substantially the same method may be used to the other colors marked in the table of FIG. 8A to obtain a DVR value range where the MCD is lower than the reference MCD of 3.00, a DVR value range where the MCD is lowest, a best DVR value, and a common voltage according to the best DVR value.

The above described embodiments may be used in a display apparatus and/or a system including the display apparatus, such as a mobile phone, a smart phone, a personal digital assistant ("PDA"), a portable media player ("PMP"), a digital camera, a digital television, a set-top box, a music player, a portable game console, a navigation device, a personal computer ("PC"), a server computer, a workstation, a tablet computer, a laptop computer, a smart card, a printer, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display apparatus comprising:

a timing controller which determines a representative grayscale of each frame based on input image data and generates a common voltage control signal having a first digital value ratio value corresponding to a first frame, a representative grayscale of the first frame being included in a first grayscale range;

a common voltage generator which generates a first common voltage based on the common voltage control signal;

a data driver which generates a data voltage based on the input image data; and a display panel which displays an image corresponding to the first frame based on the data voltage and the first common voltage, wherein the first common voltage satisfies an equation below:

$$VCOM = VCOM_M - \frac{DVR+1}{DVR_M+1} VCOM_R,$$

where VCOM denotes the first common voltage, $VCOM_M$ denotes a maximum available value of a common voltage, $VCOM_R$ denotes a variable range of a common voltage, $DVR_M$ denotes a maximum digital value ratio value, DVR denotes the first digital value ratio value.

2. The display apparatus of claim 1, wherein the first grayscale range is a grayscale range to display a dark skin color (Dark Skin).

3. The display apparatus of claim 2, wherein a red grayscale of the first grayscale range is greater than or equal to 91 and less than or equal to 97, a green grayscale of the first grayscale range is greater than or equal to 25 and less than or equal to 31, and a blue grayscale of the first grayscale range is greater than or equal to 10 and less than or equal to 16, and wherein a maximum of the red grayscale, the green grayscale and the blue grayscale is 256.

4. The display apparatus of claim 2, wherein the first digital value ratio value is greater than or equal to 64 and less than or equal to 88, and wherein a maximum of the first digital value ratio value is 127.

5. The display apparatus of claim 1, wherein the first grayscale range is a grayscale range to display a first light skin color (Light Skin 1).

6. The display apparatus of claim 5, wherein a red grayscale of the first grayscale range is greater than or equal to 194 and less than or equal to 200, a green grayscale of the first grayscale range is greater than or equal to 148 and less than or equal to 154, and a blue grayscale of the first grayscale range is greater than or equal to 127 and less than or equal to 133, and wherein a maximum of the red grayscale, the green grayscale and the blue grayscale is 256.

7. The display apparatus of claim 5, wherein the first digital value ratio value is greater than or equal to 77 and less than or equal to 101, and wherein a maximum of the first digital value ratio value is 127.

8. The display apparatus of claim 1, wherein the first grayscale range is a grayscale range to display a light skin color (Light Skin 2).

9. The display apparatus of claim 8, wherein a red grayscale of the first grayscale range is greater than or equal to 238 and less than or equal to 244, a green grayscale of the first grayscale range is greater than or equal to 146 and less than or equal to 152, and a blue grayscale of the first grayscale range is greater than or equal to 105 and less than or equal to 111, and wherein a maximum of the red grayscale, the green grayscale and the blue grayscale is 256.

10. The display apparatus of claim 8, wherein the first digital value ratio value is greater than or equal to 64 and less than or equal to 88, and wherein a maximum of the first digital value ratio value is 127.

11. The display apparatus of claim 1, wherein the common voltage control signal has a second digital value ratio value corresponding to a second frame, a representative grayscale of the second frame being included in a second grayscale range different from the first grayscale range, the common voltage generator which further generates a second common voltage based on the common voltage control signal, and the display panel which displays an image corresponding to the second frame based on the data voltage and the second common voltage.

12. The display apparatus of claim 1, wherein the timing controller generates a grayscale histogram of each frame based on the input image data and analyzes the grayscale histogram to determine the representative grayscale of each frame.

13. The display apparatus of claim 12, wherein the timing controller generates the grayscale histogram of each of a red grayscale, a green grayscale and a blue grayscale.

14. The display apparatus of claim 12, wherein the representative grayscale of each frame is a most frequent grayscale of each frame.

15. The display apparatus of claim 1, wherein the display panel displays the image according to an intensity of an electric field generated by the first common voltage and the data voltage.

16. A method of driving a display apparatus, the method comprising:

determining a representative grayscale of each frame based on input image data;

generating a common voltage control signal having a first digital value ratio value corresponding to a first frame, a representative grayscale of the first frame being included in a first grayscale range;

generating a first common voltage based on the common voltage control signal;

generating a data voltage based on the input image data; and displaying an image corresponding to the first frame based on the data voltage and the first common voltage, wherein the first common voltage satisfies an equation below:

$$VCOM = VCOM_M - \frac{DVR + 1}{DVR_M + 1} VCOM_R,$$

where VCOM denotes the first common voltage, $VCOM_M$ denotes a maximum available value of a common voltage, $VCOM_R$ denotes a variable range of a common voltage, $DVR_M$ denotes a maximum digital value ratio value, DVR denotes the first digital value ratio value.

17. The method of claim 16, wherein the first grayscale range is a grayscale range to display a dark skin color (Dark Skin) or a light skin color (Light Skin 2), and the first digital value ratio value is greater than or equal to 64 and less than or equal to 88, and wherein a maximum of the first digital value ratio value is 127.

18. The method of claim 16, wherein the first grayscale range is a grayscale range to display a first light skin color (Light Skin 1), and the first digital value ratio value is greater than or equal to 77 and less than or equal to 101, and wherein a maximum of the first digital value ratio value is 127.

19. The method of claim 16, further comprising:

generating the common voltage control signal having a second digital value ratio value corresponding to a second frame, a representative grayscale of the second frame being included in a second grayscale range different from the first grayscale range;

generating a second common voltage based on the common voltage control signal; and displaying an image corresponding to the second frame based on the data voltage and the second common voltage.

20. The method of claim 16, wherein the determining the representative grayscale of each frame comprises:

generating a grayscale histogram of each frame based on the input image data; and analyzing the grayscale histogram to determine the representative grayscale of each frame.

21. A method of driving a display apparatus, the method comprising:

generating a data voltage based on input image data;

generating a first common voltage corresponding to a first input image having a first color, a mixed color difference of the first input image being a lowest value at the first common voltage;

generating a second common voltage corresponding to a second input image having a second color different from the first color, a mixed color difference of the second input image being the lowest value at the second common voltage;

displaying the first input image based on the data voltage and the first common voltage; and displaying the second input image based on the data voltage and the second common voltage.

* * * * *